US007232206B2

(12) United States Patent
Sasaki et al.

(10) Patent No.: US 7,232,206 B2
(45) Date of Patent: Jun. 19, 2007

(54) INK-JET HEAD, INK-JET PRINTER USING THE SAME, AND PROCESS FOR PRODUCING INK-JET HEAD

(75) Inventors: Hiroshi Sasaki, Ibaraki (JP); Makoto Kurosawa, Ibaraki (JP); Yoshinari Suzuki, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 244 days.

(21) Appl. No.: 10/834,248

(22) Filed: Apr. 29, 2004

(65) Prior Publication Data

US 2004/0223033 A1 Nov. 11, 2004

(30) Foreign Application Priority Data

May 9, 2003 (JP) ..... P2003-131638

(51) Int. Cl.
*B41J 2/135* (2006.01)
*B05D 5/00* (2006.01)

(52) U.S. Cl. ..... 347/45; 427/287

(58) Field of Classification Search ..... 347/20, 347/44–45, 47

See application file for complete search history.

(56) References Cited

U.S. PATENT DOCUMENTS 5,502,470 A * 3/1996 Miyashita et al. ..... 347/45
6,156,824 A * 12/2000 Yamada et al. ..... 523/462
6,273,348 B1 8/2001 Shouji et al.
6,737,109 B2 * 5/2004 Stanton et al. ..... 347/45
6,966,630 B2 * 11/2005 Sasaki et al. ..... 347/45
2002/0097296 A1 7/2002 Yamamoto et al.

FOREIGN PATENT DOCUMENTS

| | | | |
|---|---|---|---|
| DE | 602 09 059 T2 | | 8/2003 |
| EP | 1 273 448 | | 8/2003 |
| JP | 57107848 A | * | 7/1982 |
| JP | 11-311168 | | 11/1999 |
| JP | 2001-90638 | | 4/2001 |
| JP | 2002-187267 | | 7/2002 |
| JP | 2002-187268 | | 7/2002 |
| JP | 2003-19803 | | 1/2003 |
| JP | 2003-63014 | | 3/2003 |
| JP | 2003-154663 | | 5/2003 |
| JP | 2003-191476 | | 7/2003 |
| JP | 2004-1494 | | 1/2004 |

* cited by examiner

*Primary Examiner*—Stephen Meier
*Assistant Examiner*—Lisa M. Solomon
(74) *Attorney, Agent, or Firm*—McGinn IP Law Group, PLLC

(57) ABSTRACT

In an ink-jet head having an orifice ejecting an ink for forming an image, the ink-jet head further has a water repellent film for repelling the ink on a surface of the orifice, and the water repellent film has a fluorine-containing polymer resin layer and a part having a perfluoropolyether chain or a perfluoroalkyl chain bonded on the layer, whereby an ink-jet head and an ink-jet printer having a water repellent film having high water repelling property to an oil-based ink and high abrasion resistance can be provided.

19 Claims, 4 Drawing Sheets

INK-JET HEAD, INK-JET PRINTER USING THE SAME, AND PROCESS FOR PRODUCING INK-JET HEAD

BACKGROUNG OF THE INVENTION

1. Field of the Invention

The present invention relates to an ink-jet head having a water repellent film having high abrasion resistance on an orifice, an ink-jet printer using the same, and a process for producing the ink-jet head.

2. Description of the Related Art

Various kinds of water repellent materials have been developed for preventing adhesion of contamination and waterproofing. Silicone series materials and fluorine series materials are being mainly studied as a water repellent material. As comparing the silicone series materials and the fluorine series materials, the fluorine series materials are advantageous for decreasing surface energy of a surface of a material. Examples of the fluorine series materials having been studied include a compound having a perfluoroalkyl chain and a compound having a perfluoropolyether chain as a monomolecular film, and a fluorine-containing polymer resin as a polymer film.

Examples of the water repellent material include household use with water, such as kitchen and lavatory, automobiles, such as windows and bodies, and office use, such as a surface of a display and an orifice surface of a head of an ink-jet printer. An ink-jet printer is being spread not only into office use but also into home use owing to small size thereof in comparison to an electrophotographic printer. Image formation of the ink-jet printer is attained by ejecting ink droplets from an orifice opening of a nozzle of a head to paper, and attaching the ink droplets on the paper. In the case where an ink is attached and dried in the vicinity of the orifice opening at this time, there are some cases where ink droplets newly ejected is in contact therewith to deviate the ejecting direction. An ordinary ink-jet printer therefore has an orifice surface of the head having been subjected to a treatment for repelling an ink (i.e., water repelling treatment) and has a mechanism for wiping the orifice surface.

An ink used for image formation of an ink-jet printer includes an oil-based ink as well as aqueous ones, and some of them contain an organic resin component. The ink of this type has a small surface tension and thus causes such problems that the ink can be repelled only by a water repellent film having high water repelling property, and in the case where the ink is dried in the vicinity of the nozzle, it is solidified and adhere thereon. According to investigations made by the inventors, it has been found that it is necessary that an orifice part of a nozzle has a contact angle of at least 50° even in the case of an oil-based ink.

SUMMARY OF THE INVENTION

A fluorine-containing polymer resin, such as PTFE (polytetrafluoroethylene, produced by Du Pont Corp.) and Cytop (a trade name, produced by Asahi Glass Co., Ltd.), has a contact angle with water of about from 105 to 110°. It is insufficient in water repelling property to some kinds of oil-based inks. In the case of oil-based inks that cannot be repelled with the water repelling power of PTFE and Cytop, a film formed with a perfluoropolyether compound having an alkoxysilane residual group at an end thereof, such as Optool DSX, produced by Daikin Industries, Ltd., exhibiting larger water repelling property than PTFE and Cytop or a film formed with a perfluoroalkyl compound is used. These films have a large contact angle with water of 120°.

However, a water repellent film formed with the perfluoropolyether compound or the perfluoroalkyl compound has such a tendency that the water repelling property on the surface thereof is significantly lowered when an ink is in contact therewith for a prolonged period of time. This is because of the following reasons. The perfluoropolyether chains or the perfluoroalkyl chains are sparsely planted on a solid surface (i.e., the orifice surface in the case of the head) to form the film, but the solid surface consequently does not covered therewith completely. Therefore, an ink is attached to parts that are not covered therewith, and the ink wets the parts and then spreads to wet the whole orifice surface consequently. The fluorine-containing polymer resin, such as PTFE and Cytop, is free of the problem because it can be formed to cover the whole solid surface.

In the case of wiping a surface of a water repellent film formed with the fluorine-containing polymer resin, the perfluoropolyether compound or the perfluoroalkyl compound, the contact angle of the film is lowered due to separation of the film or the like reasons. In the case of an ink containing a pigment dispersed therein, in particular, the particles of the pigment function as an abrasive to cause significant decrease in contact angle by scraping the water repellent film. The problem can be solved by increasing the thickness in the case of the film formed with the fluorine-containing polymer resin, but there is a limitation in increasing the thickness because the thickness is necessarily in submicron order upon applying to a head of an ink-jet printer. In an ink-jet printer having a water repelling film on a head, it is necessary that the orifice surface of the head is wiped with silicone rubber or the like materials at regular time intervals for cleaning the orifice surface during the period where the power is on. For example, it is assumed that the wiping operation is carried out per 10 minutes for an ink-jet printer having been turned for 8 hours per day, the head is wiped about 50,000 times per 3 years. There is currently no water repellent film that maintains sufficient water repelling property after the repeated wiping.

Under the circumstances, such a water repellent film is demanded that has both the advantages, i.e., the durability of the fluorine-containing polymer resin and the high water repelling property of the perfluoropolyether compound and the perfluoroalkyl compound.

As a result of investigations of various method for solving the problems made by the inventors, it has been found that the problems can be solved by using a film having a structure containing a layer formed with a fluorine-containing polymer film having bonded thereon a part having a perfluoropolyether chain or a perfluoroalkyl chain. In particular, it has also found that a perfluoropolyether compound having an alkoxysilane residual group at an end thereof provides a film that effectively repels water and an oil-based ink.

Furthermore, it has been found that a water repellent film having high abrasion resistance can be obtained by irradiating the layer formed with a fluorine-containing polymer resin with oxygen plasma before forming the part having a perfluoropolyether chain or a perfluoroalkyl chain. The invention includes the following specific features.

According to an aspect of the invention, an ink-jet head comprises an orifice ejecting an ink for forming an image and a water repellent film for repelling the ink on a surface of the orifice, wherein the water repellent film comprises a fluorine-containing polymer resin layer and a part having at least one of perfluoropolyether chain and a perfluoroalkyl chain bonded on the layer.

According to a second aspect of the invention, an ink-jet head comprises an orifice ejecting an ink for forming an image and a water repellent film for repelling the ink on a surface of the orifice, wherein the water repellent film comprises a fluorine-containing polymer resin layer and a part having at least one of perfluoropolyether chain and a perfluoroalkyl chain bonded on the layer, and the water repellent film is produced by a process which comprises coating a solution containing a fluorine-containing polymer resin and evaporating a solvent to form the fluorine-containing polymer resin layer, irradiating the fluorine-containing polymer resin layer with oxygen plasma, coating a solution containing at least one of a perfluoropolyether compound having an alkoxysilane residual group at an end thereof and a perfluoroalkyl compound having an alkoxysilane residual group at an end thereof on a surface of the fluorine-containing layer, and heating the coated layer to bond at least one of the perfluoropolyether compound and the perfluoroalkyl compound on the surface of the fluorine-containing layer.

According to a third aspect of the invention, the ink-jet head provides the part having a perfluoropolyether chain on the fluorine-containing polymer resin layer which is formed with a compound having one of the following chemical formulae:

$$F\{CF(CF_3)—CF_2O\}_n—CF(CF_3)—X—Si(OR)_3$$

$$F\{CF(CF_3)—CF_2O\}_n—CF(CF_3)—X—Si(OR)_2R$$

$$F(CF_2CF_2CF_2O)_nCF_2CF_2—X—Si(OR)_3$$

$$F(CF_2CF_2CF_2O)_nCF_2CF_2—X—Si(OR)_2R$$

$$[F\{CF(CF_3)—CF_2O\}_nCF(CF_3)]_2Y—Si(OR)_3$$

$$[F\{CF(CF_3)—CF_2O\}_nCF(CF_3)]_2Y—Si(OR)_2R$$

$$\{F(CF_2CF_2CF_2O)_nCF_2CF_2\}_2Y—Si(OR)_3$$

$$\{F(CF_2CF_2CF_2O)_nCF_2CF_2\}_2Y—Si(OR)_2R$$

where X and Y each represents a part at which the perfluoropolyether chain and an alkoxysilane residual group are bonded each other, and R represents an alkyl group.

According to a fourth aspect of the invention, the ink-jet head provides the water repellent film which is formed on an inner surface of the orifice to a depth of ¼ or less of an opening diameter of the orifice from the surface of the orifice.

According to a fifth aspect of the invention, an ink-jet printer comprises an ink-jet head ejecting an ink for forming an image, wherein the ink-jet head comprises an orifice and a water repellent film for repelling the ink on a surface of the orifice, wherein the water repellent film comprises a fluorine-containing polymer resin layer and a part having at least one of perfluoropolyether chain and a perfluoroalkyl chain bonded on the layer.

According to a sixth aspect of the invention, a process for producing a water repellent film on a surface of an orifice of an ink-jet head comprises coating a solution containing a fluorine-containing polymer resin and evaporating a solvent to form a fluorine-containing polymer resin layer, irradiating the fluorine-containing polymer resin layer with oxygen plasma, coating a solution containing at least one of a perfluoropolyether compound having an alkoxysilane residual group at an end thereof and a perfluoroalkyl compound having an alkoxysilane residual group at an end thereof on a surface of the fluorine-containing layer and heating the coated layer to bond at least one of the perfluoropolyether compound and the perfluoroalkyl compound on the surface of the fluorine-containing layer.

According to a seventh aspect of the invention, in the process for producing a water repellent film on a surface of an orifice of an ink-jet head, a part having a perfluoropolyether chain on the fluorine-containing polymer resin layer which is formed with a compound having one of the following chemical formulae:

$$F\{CF(CF_3)—CF_2O\}_n—CF(CF_3)—X—Si(OR)_3$$

$$F\{CF(CF_3)—CF_2O\}_n—CF(CF_3)—X—Si(OR)_2R$$

$$F(CF_2CF_2CF_2O)_nCF_2CF_2—X—Si(OR)_3$$

$$F(CF_2CF_2CF_2O)_nCF_2CF_2—X—Si(OR)_2R$$

$$[F\{CF(CF_3)—CF_2O\}_nCF(CF_3)]_2Y—Si(OR)_3$$

$$[F\{CF(CF_3)—CF_2O\}_nCF(CF_3)]_2Y—Si(OR)_2R$$

$$\{F(CF_2CF_2CF_2O)_nCF_2CF_2\}_2Y—Si(OR)_3$$

$$\{F(CF_2CF_2CF_2O)_nCF_2CF_2\}_2Y—Si(OR)_2R$$

According to a eighth aspect of the invention, in the process for producing a water repellent film on a surface of an orifice of an ink-jet head, the water repellent film is formed on an inner surface of the orifice to a depth of ¼ or less of an opening diameter of the orifice from the surface of the orifice.

DETAILED DESCRIPTION OF THE PREFFERED EMBODIMENTS

1. Water Repellent Material, Treating Method and the Like

Figure 1:
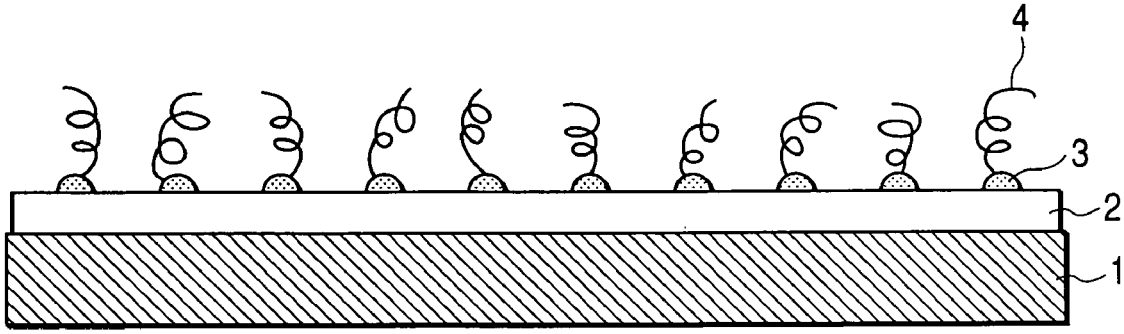
FIG. 1 is a schematic cross sectional diagram showing a water repellent film according to the invention.

In the ink-jet head according to the invention, the water repellent film formed on the orifice contains the fluorine-containing polymer resin and at least one of the perfluoropolyether compound and the perfluoroalkyl compound. FIG. 1 shows a schematic cross sectional diagram thereof.

A substrate 1 has formed thereon a layer 2 containing a fluorine-containing polymer resin, and further formed thereon through a bonding site 3 a part 4 having at least one of perfluoropolyether chain and a perfluoroalkyl chain. The constitutional components will be described in detail below.

(1) Fluorine-containing Polymer Resin

Examples of the fluorine-containing polymer resin include resins insoluble in a solvent or having low solubility, such as polytetrafluoroethylene (PTFE), a tetrafluoroethylene-perfluoroalkyl vinyl ether copolymer (PFA), a tetrafluoroethylene-hexafluoropropylene copolymer (FEP), polychlorotetrafluoroethylene (PCTFE), a tetrafluoroethylene-ethylene copolymer (ETFE), a chlorotrifluoroethylene-ethylene copolymer (ECTFE), polyvinylidene fluoride (PVdF) and polyvinyl fluoride (PVF). The resin may be fixed to a substrate with a fixing member, such as a screw, or formed into a film by press-adhering on a substrate under heat.

Examples of the material soluble in a solvent include Cytop (a trade name, produced by Asahi Glass Co., Ltd.) and INT-304VC (a trade name, produced by INT Screen Co., Ltd.). Cytop differs in solvent, concentration, average molecular weight and the like depending on the model numbers thereof, and a suitable material may be selected according to the substrate and the film formation conditions. In order to improve adhesiveness to the substrate, it is preferred that the substrate is previously treated with a silane coupling agent, such as an alkoxysilane compound and a trichlorosilane compound, and a titanium coupling agent, such as an alkoxytitanium compound. There are some cases where the adhesiveness can be improved by mixing the coupling agent with the solution of the fluorine-containing polymer resin.

The aforementioned materials are preferably an amorphous resin because uniformity in film thickness can be ensured in comparison to a crystalline material upon forming the thin film on the surface of the orifice in the invention.

(2) Perfluoropolyether Compound

The perfluoropolyether compound is preferably a compound having a perfluoropolyether chain and an alkoxysilane residual group in one molecule. This is because such a compound improves the adhesiveness to the fluorine-containing polymer resin having been formed as an underlayer of the water repellent film. The compound also has such a characteristic feature that it does not migrate on the film surface to enable control of the water repellent region. Examples thereof include those represented by the following general formulae:

$$F\{CF(CF_3)—CF_2O\}_n—CF(CF_3)—X—Si(OR)_3$$

$$F\{CF(CF_3)—CF_2O\}_n—CF(CF_3)—X—Si(OR)_2R$$

$$F(CF_2CF_2CF_2O)_nCF_2CF_2—X—Si(OR)_3$$

$$F(CF_2CF_2CF_2O)_nCF_2CF_2—X—Si(OR)_2R$$

$$[F\{CF(CF_3)—CF_2O\}_nCF(CF_3)]_2Y—Si(OR)_3$$

$$[F\{CF(CF_3)—CF_2O\}_nCF(CF_3)]_2Y—Si(OR)_2R$$

$$\{F(CF_2CF_2CF_2O)_nCF_2CF_2\}_2Y—Si(OR)_3$$

$$\{F(CF_2CF_2CF_2O)_nCF_2CF_2\}_2Y—Si(OR)_2R$$

where X and Y each represents a part at which the perfluoropolyether chain and an alkoxysilane residual group are bonded each other, and R represents an alkyl group.

Examples of a synthesis process of the water repellent treating agent encompassed by the aforementioned general formulae (Compounds 1 to 4) will be described.

(Synthesis of Compound 1)

25 parts by weight of Krytox 157FS-L, produced by Du Pont Corp. (average molecular weight: 2,500) was dissolved in 100 parts by weight of PF-5080, produced by 3M Corp., to which 20 parts by weight of thionyl chloride was added, followed by refluxing under stirring for 48 hours. Thionyl chloride and PF-5080 were evaporated with an evaporator to obtain 25 parts by weight of a compound in which the carboxyl group of Krytox 157FS-L was converted to a chloroformyl group. 100 parts by weight of PF-5080, 3 parts by weight of Sila Ace S330, produced by Chisso Corp. and 3 parts by weight of triethylamine were added thereto, and the mixture was stirred at room temperature for 20 hours. The reaction mixture was filtered with Radiolite Fineflow A, produced by Showa Chemical Co., Ltd., and PF-5080 in the filtrate was evaporated with an evaporator to obtain 20 parts by weight of Compound 1.

$$F\{CF(CF_3)—CF_2O\}_n—CF(CF_3)—CONH—(CH_2)_3—Si(OCH_2CH_3)_3 \qquad \text{Compound 1}$$

(Synthesis of Compound 2)

20 parts by weight of Compound 2 was obtained in the same manner as in the synthesis of Compound 1 except that 3 parts by weight of Sila Ace S360, produced by Chisso Corp. was used instead of 3 parts by weight of Sila Ace S330, produced by Chisso Corp.

$$F\{CF(CF_3)—CF_2O\}_n—CF(CF_3)—CONH—(CH_2)_3—Si(OCH_3)_3 \qquad \text{Compound 2}$$

(Synthesis of Compound 3)

30 parts by weight of Compound 3 was obtained in the same manner as in the synthesis of Compound 1 except that 35 parts by weight of Demnum SH, produced by Daikin Industries, Ltd. (average molecular weight: 3,500) was used instead of 25 parts by weight of Krytox 157FS-L, produced by Du Pont Corp. (average molecular weight: 2,500).

$$F\{CF_2CF_2CF_2O\}_n—CF_2CF_2—CONH—(CH_2)_3—Si(OCH_2CH_3)_3 \qquad \text{Compound 3}$$

(Synthesis of Compound 4)

30 parts by weight of Compound 4 was obtained in the same manner as in the synthesis of Compound 1 except that 3 parts by weight of Sila Ace S360, produced by Chisso Corp. was used instead of 3 parts by weight of Sila Ace S330, produced by Chisso Corp., and 35 parts by weight of Demnum SH, produced by Daikin Industries, Ltd. (average molecular weight: 3,500) was used instead of 25 parts by weight of Krytox 157FS-L, produced by Du Pont Corp. (average molecular weight: 2,500).

$$F\{CF_2CF_2CF_2O\}_n—CF_2CF_2—CONH—(CH_2)_3—Si(OCH_3)_3 \qquad \text{Compound 4}$$

The inventors have found that the abrasion resistance is improved in the case where the compound has plural perfluoropolyether chain in one molecule. Examples of the compound include those represented by the following general formulae:

$$[F\{CF(CF_3)—CF_2O\}_nCF(CF_3)]_2Y—Si(OR)_3$$

$$[F\{CF(CF_3)—CF_2O\}_nCF(CF_3)]_2Y—Si(OR)_2R$$

$$\{F(CF_2CF_2CF_2O)_nCF_2CF_2\}_2Y—Si(OR)_3$$

$$\{F(CF_2CF_2CF_2O)_nCF_2CF_2\}_2Y—Si(OR)_2R$$

where Y represents a part at which the perfluoropolyether chain and an alkoxysilane residual group are bonded each other, and R represents an alkyl group.

Examples of a synthesis process of the water repellent treating agent encompassed by the aforementioned general formulae (Compounds 5 to 8) will be described.

(Synthesis of Compound 5)

25 parts by weight of Krytox 157FS-L, produced by Du Pont Corp. (average molecular weight: 2,500) was dissolved in 100 parts by weight of PF-5080, produced by 3M Corp., to which 20 parts by weight of thionyl chloride was added, followed by refluxing under stirring for 48 hours. Thionyl chloride and PF-5080 were evaporated with an evaporator to obtain 25 parts by weight of a compound in which the carboxyl group of Krytox 157FS-L was converted to a chloroformyl group. 100 parts by weight of PF-5080, 1 part by weight of Sila Ace S320, produced by Chisso Corp. and 3 parts by weight of triethylamine were added thereto, and the mixture was stirred at room temperature for 20 hours. The reaction mixture was filtered with Radiolite Fineflow A, produced by Showa Chemical Co., Ltd., and PF-5080 in the filtrate was evaporated with an evaporator to obtain 20 parts by weight of Compound 5.

$$F\{CF(CF_3)-CF_2O\}_n-CF(CF_3)-CONH-(CH_2)_2-\underset{\underset{F\{CF(CF_3)-CF_2O\}_n-CF(CF_3)-CO}{|}}{N}-(CH_2)_3-Si(OCH_3)_3$$

Compound 5

(Synthesis of Compound 6)

20 parts by weight of Compound 6 was obtained in the same manner as in the synthesis of Compound 5 except that 1 part by weight of Sila Ace S310, produced by Chisso Corp. was used instead of 1 part by weight of Sila Ace S320, produced by Chisso Corp.

$$F\{CF(CF_3)-CF_2O\}_n-CF(CF_3)-CONH-(CH_2)_2-\underset{\underset{F\{CF(CF_3)-CF_2O\}_n-CF(CF_3)-CO}{|}}{N}-(CH_2)_3-Si(OCH_3)_2CH_3$$

Compound 6

(Synthesis of Compound 7)

30 parts by weight of Compound 7 was obtained in the same manner as in the synthesis of Compound 5 except that 35 parts by weight of Demnum SH, produced by Daikin Industries, Ltd. (average molecular weight: 3,500) was used instead of 25 parts by weight of Krytox 157FS-L, produced by Du Pont Corp. (average molecular weight: 2,500).

$$F\{CF_2CF_2CF_2O\}_n-CF_2CF_2-CONH-(CH_2)_3-\underset{\underset{F\{CF_2CF_2CF_2O\}_n-CF_2CF_2-CO}{|}}{N}-(CH_2)_3-Si(OCH_3)_3$$

Compound 7

(Synthesis of Compound 8)

30 parts by weight of Compound 8 was obtained in the same manner as in the synthesis of Compound 5 except that 1 part by weight of Sila Ace S310, produced by Chisso Corp. was used instead of 1 part by weight of Sila Ace S320, produced by Chisso Corp., and 35 parts by weight of Demnum SH, produced by Daikin Industries, Ltd. (average molecular weight: 3,500) was used instead of 25 parts by weight of Krytox 157FS-L, produced by Du Pont Corp. (average molecular weight: 2,500).

$$F\{CF_2CF_2CF_2O\}_n-CF_2CF_2-CONH-(CH_2)_3-\underset{\underset{F\{CF_2CF_2CF_2O\}_n-CF_2CF_2-CO}{|}}{N}-(CH_2)_3-Si(OCH_3)_2CH_3$$

Compound 8

The average molecular weight of the water repellent treating agent is generally about from 1,000 to 12,000 while it depends on the size of the perfluoropolyether chain and the number of the perfluoropolyether chain in one molecule. The water repellent membrane formed by the compound is a layer of molecular level having a thickness of several nanometers. The thickness of the membrane can be obtained with a non-contact membrane thickness measuring device (Ellipsometer, produced by Mizojiri Optical Co., Ltd.) or can be obtained by measuring the CF stretching vibration near 1,200 Kayser in the IR spectrum of reflection mode. As a result of experimentation by the inventors, it has been found that the surfaces treated with these water repellent agents repel not only an aqueous ink easily soluble in water but also an oil-based ink insoluble or hardly soluble in water.

The water repellent membrane can be formed with the water repellent treating agent in the following manner. A solution is prepared by diluting the water repellent treating agent in a solvent. The solution is then coated on an orifice plate by brush coating, spray coating, spin coating, dip coating or the like methods. The solution thus coated is then heated to react the alkoxysilane residual group of the water repellent treating agent and the hydroxyl group on the surface of the orifice plate each other, whereby the water repellent treating agent is chemically bonded to the surface of the orifice plate to form a water repellent membrane. The water repellent treating agent used in the invention was hydrolyzed upon contacting with water. It also necessarily penetrates into a nozzle having a diameter of from 10 to 50 μm. Therefore, the solvent used for preparing the coating solution is preferably a fluorine solvent having a low water content and a small surface tension. Specific examples thereof include FC-72, FC-77, PF-5060, PF-5080, HFE-7100 and HFE-7200, produced by 3M Corp., and Vertrel XF, produced by Du Pont Corp.

In the aforementioned chemical formulae, X and Y each represents a part at which the perfluoropolyether chain and the alkoxysilane residual group are bonded to each other. The part is not particularly limited, and is preferably a group having such a structure that does not suffer hydrolysis even in the case where an ink having slightly alkaline nature is used. Examples thereof include those containing an amide bond or an ether bond. The group preferably does not contain an ester bond and an ion bond. Specific examples include the following.

Examples of Group Represented by X $$-CONH-(CH_2)_3- \quad -CH_2O-(CH_2)_3- \quad -CO_2-(CH_2)_3- \quad -CH_2NH-(CH_2)_3-$$

Examples of Group Represented by Y

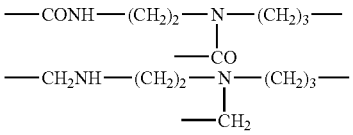

(3) Method for Forming Film

The water repellent film of the invention can be formed in the following manner. In the case where the fluorine-containing polymer resin is a material that is soluble in a fluorine solvent, such as Cytop, a solvent of the fluorine-containing polymer resin is coated on a substrate, on which the water repellent film is to be formed, and then the solvent is evaporated, or the resin is cured under heat, so as to form the fluorine-containing polymer resin layer on the surface of the substrate. In the case of polytetrafluoroethylene (PTFE), a tetrafluoroethylene-perfluoroalkyl vinyl ether copolymer (PFA), a tetrafluoroethylene-hexafluoropropylene copolymer (FEP), polychlorotetrafluoroethylene (PCTFE), a tetrafluoroethylene-ethylene copolymer (ETFE), a chlorotrifluoroethylene-ethylene copolymer (ECTFE), polyvinylidene fluoride (PVdF), polyvinyl fluoride (PVF) and the like, which are fluorine-containing polymer resins that are not dissolved in a fluorine solvent, a thin film thereof is fixed on the surface of the substrate with a fixing member, such as a screw, to form the film. In the case where the surface has unevenness, and the fluorine-containing polymer resin to be used is thermoplastic, the film can be formed by press-adhering under heat.

After the film is irradiated with oxygen plasma, exposed to ozone, or irradiated with an UV ray, a solution of the perfluoroalkyl compound or the perfluoropolyether compound is coated thereon, and then the solvent is evaporated, or the film is cured under heat. Consequently, a layer containing the part having a perfluoropolyether chain or a perfluoroalkyl chain is formed on the fluorine-containing polymer resin layer. A basic method for forming the film has been described.

In the case where the fluorine-containing polymer resin layer is irradiated with oxygen plasma with a plasma asher before coating the solution of the perfluoroalkyl compound or the perfluoropolyether compound, substituents, such as hydroxyl groups, are formed on the surface of the fluorine-containing polymer resin layer. A perfluoroalkyl compound or a perfluoropolyether compound, which has a chlorosilane residual group or an alkoxysilane residual group at an end thereof, is firmly bonded to the fluorine-containing polymer resin layer by bonding the chlorosilane residual group or the alkoxysilane residual group is bonded to the hydroxyl group formed by irradiation with plasma associated with oxidation, which is favorable in the case where abrasion resistance is demanded. The similar favorable effect can be expected by irradiating with an UV ray or exposing to ozone instead of oxygen plasma. However, as being different from the case of oxygen plasma, there is such a tendency that the abrasion resistance cannot be further improved by prolonging the irradiating time or the exposing time in comparison to oxygen plasma.

As a result of experimentation by the inventors, it has been found that the water repelling property and the abrasion resistance of the layer formed with the perfluoroalkyl compound or the perfluoropolyether compound vary depending on the irradiating amount of oxygen plasma to the fluorine-containing polymer resin layer with a plasma asher. In the case where the irradiating time or the output power of the high frequency power source of the plasma asher (which corresponds to the amount of plasma generated per unit time) is increased, there is such a tendency that the water repelling property and the abrasion resistance are increased to certain extent. However, in the case where they are further increased beyond the certain extent, there is such a tendency that the water repelling property and the abrasion resistance are adversely lowered. This is because the surface of the fluorine-containing polymer resin layer is oxidized with oxygen plasma, and the layer itself is simultaneously ground down therewith, whereby the fluorine-containing polymer resin layer finally runs out through excess irradiation of oxygen plasma to form a water repellent layer having a substantially one-layer structure. Therefore, it is necessary that the irradiation conditions of oxygen plasma are controlled, but the optimum conditions vary depending on the chemical structure of the fluorine-containing polymer resin layer and the thickness of the layer, and cannot be determined unconditionally.

2. Constitutions of Ink-jet Head and Printer

An ink-jet head and a printer using the water repellent film according to the invention will be described.

2.1 Orifice Plate

Figure 2:
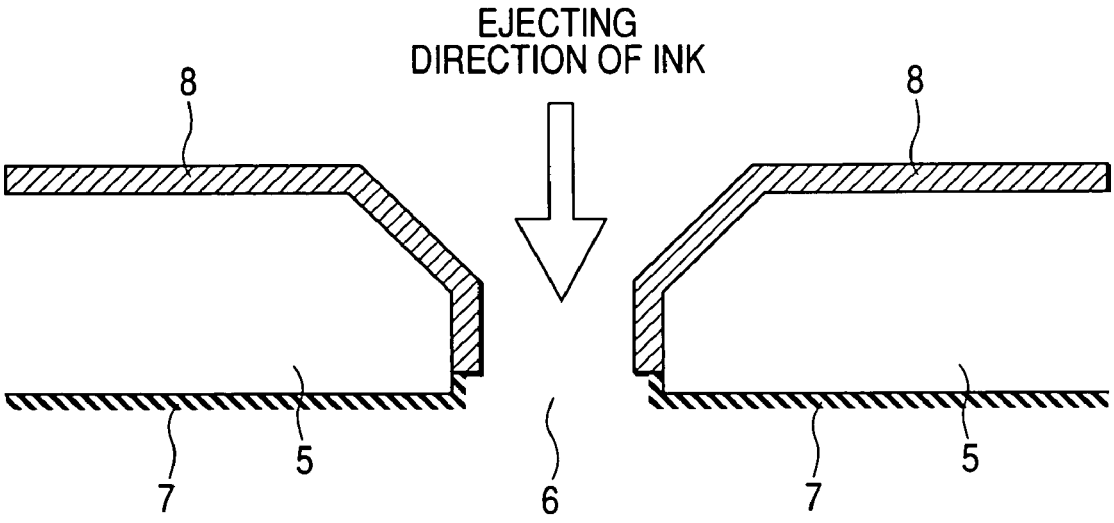
FIG. 2 is a schematic cross sectional view showing an orifice plate of an ink-jet head used in the invention.

FIG. 2 is a schematic cross sectional view showing an orifice plate of an ink-jet head.

An ink-jet head has plural nozzles, and the nozzles each has an ink chamber, a driving element, such as a piezoelectric element and a heater element, an orifice as an opening for ejecting ink droplets (details of which will be described later). Ink droplets are ejected from an orifice opening 6. The orifice opening 6 is formed with an orifice plate 5. A water repellent film 7 is formed on the surface of the orifice plate 5, from which the ink is ejected. The surface of the orifice is subjected to a water repelling treatment because of the following reasons. In the case where an ink is attached to the orifice surface in the vicinity of the orifice opening 6, the ejecting direction of the ink subsequently ejected is deviated, and the ink is not landed on a predetermined position. Therefore, the orifice surface is necessarily subjected to a water repelling treatment for preventing the ink from being adhered in the vicinity of the orifice opening 6.

The water repellent film is also formed on an inner surface of the orifice. As a result of an ink ejecting test by using various kinds of inks with nozzles having various sizes and a water repellent film formed to various depths, a predetermined amount of an ink is ejected in the case where the water repellent film is formed to a depth of ¼ or less of the nozzle diameter. However, the ejecting amount is significantly decreased in the case where the depth exceeds ¼ of the nozzle diameter. It is considered that this is because the water repelling function of the water repellent film formed on a region deeper than ¼ of the nozzle diameter inhibits ejection of the ink.

A hydrophilic film 8 is formed on a surface of an ink flow channel from a part of the orifice plate 5 having no water repellent film 7 to an ink chamber. The hydrophilic film 8 is provided for improving the wettability of the ink flow channel and also has, as a result, such a function that bubbles are prevented from being formed in the flow channel. In the case where bubbles are formed on the path from the ink chamber to the orifice opening 6 through the ink flow channel, ink droplets are not ejected from the orifice opening 6 even though the driving element intends to eject the ink. This is because the bubbles absorb the pressure generated by the driving element, and the pressure necessary for ejecting the ink is not transmitted to the ink. Generation of bubbles is suppressed by providing the hydrophilic film 8 on the surface of the ink flow channel including from the part of the orifice plate 5 having no water repellent film 7 to the ink chamber to ensure the ink being ejected normally. The hydrophilic film is necessarily provided in the case of an aqueous ink since it has a surface tension of a certain extent. However, the necessity of the hydrophilic film is decreased in the case of an oil-based ink since it has a low surface tension, and bubbles are hardly generated in the flow channel. Therefore, the hydrophilic film may not be provided in some cases.

2.1.1 Water Repellent Treating Agent and Treating Method

The treating agent for carrying out the water repelling treatment and the method for forming the water repellent film have been described in the aforementioned section 1. Water Repellent Material, Treating Method and the like.

The method for producing the water repellent film by using the water repellent treating agent includes a method using a tape and a water soluble resin described in the examples described later. In addition to this, it is possible that the water repellent film is formed on the whole surface of the orifice plate, and the unnecessary part thereof is physically removed by a plasma asher, sand blasting or the like method.

The water repellent film on the inner surface of the nozzle is formed to a depth of ¼ or less of the nozzle diameter. In the case where it is formed exceeding ¼, there is such a tendency that the ink ejection is suppressed.

2.1.2 Material for Orifice Plate

A material for the orifice plate will be described in detail below. The orifice plate preferably contains a large amount of a hydroxyl group for reacting with the water repellent treating agent and is therefore preferably a metallic material. In particular, those having a large content of iron, chromium and the like are preferred. However, in the case where an aqueous ink is used, water contained in the air is liable to be dissolved therein in comparison to an oil-based ink, and there is such a possibility that water dissolved therein corrodes the nozzle. Accordingly, the material for the orifice plate is preferably stainless steel from the standpoint of preventing rust. Specific examples thereof include an austenite series material, such as SUS201, SUS202, SUS301, SUS302, SUS303, SUS303Se, SUS304, SUS304L, SUS304N1, SUS304N2, SUS304NL, SUS305, SUS309S, SUS310S, SUS316, SUS316L, SUS316N, SUS316NL, SUS316J1, SUS316J1L, SUS317, SUS317L, SUS317J1, SUS321, SUS347, SUSXM7, SUSXM15J1 and SUS329J1, a ferrite series material, such as SUS405, SUS410L, SUS430, SUS430F, SUS434, SUS447J1 and SUSXM27, a martensite series material, such as SUS403, SUS410, SUS410J1, SUS416, SUS420J1, SUS420F, SUS431, SUS440A, SUS440B, SUS440C and SUS440F, and a precipitation hardening series material, such as SUS630 and SUS631.

In the case where the ink contains an antirust agent, an iron-nickel alloy may be used, which is liable to be corroded. In the case where the mother material of the housing for the ink-jet head is a silicon wafer, and the housing and the orifice plate are adhered with a thermosetting adhesive, an iron-nickel alloy having a proportion of iron and nickel of from 50/50 to 65/35 is preferably used since the linear expansion coefficient thereof is close to that of a silicon wafer.

A hydroxyl group can be introduced into other materials than metals by oxygen plasma or the like method. Examples of the materials include an inorganic material, such as a silicon wafer and zirconium oxide, and a resin, such as polyimide and polypropylene. Those materials that do not cause changes, such as dissolution and swelling, upon contacting an ink to be used are preferred.

2.1.3 Hydrophilic Treating Agent and Treating Method

The part of the nozzle surface that is necessarily subjected to the hydrophilic treatment can be imparted with hydrophilicity by such a method as formation of a hydrophilic film by coating and curing a hydrophilic treating material and a method using physical stimulation, such as irradiation of plasma.

In the case using the hydrophilic treating material, the hydrophilic treatment can be made in the following manner. An orifice having been subjected to a water repelling treatment on a necessary part thereof is combined with an ink-jet head, and a coating composition containing the hydrophilic treating material is charged from an ink feeding port. The excessive material is discharged from the orifice opening to coat the material on the necessary part, and the material is cured, for example, by heating to complete the hydrophilic treatment. The necessary part of the surface of the orifice is previously subjected to the water repelling treatment, whereby the hydrophilic treatment on the unnecessary part can be prevented.

Examples of the hydrophilic treating material include colloidal silica and hydrophilic alumina. Examples of colloidal silica include IPA-ST and MT-ST, produced by Nissan Chemical Industries, Ltd., and examples of hydrophilic alumina include Hydrophilic Alumina 520, produced by Nissan Chemical Industries, Ltd. As a binder for retaining the material as the hydrophilic film, silica sol formed by polymerizing alkoxysilane to an average molecular weight of several thousands is preferably used. A binder formed with an organic resin has such a tendency that the hydrophilicity of the hydrophilic material is largely decreased due to high water repelling property thereof in comparison to silica sol. In addition to this, polyethylene glycol, polyvinyl alcohol, polyethyleneimine and the like function as a hydrophilic film after coating on the flow channel. These are water soluble polymers and are suitable for an oil-based ink rather but not for an aqueous ink.

Examples of the method for imparting hydrophilicity by physical stimulation include oxygen plasma, ozone oxidation and irradiation of an UV ray. However, these methods have such a tendency that the retention time of hydrophilicity is short in comparison to the hydrophilic film formed by using the hydrophilic treating material.

2.2 Ink-jet Head

Figure 3A:
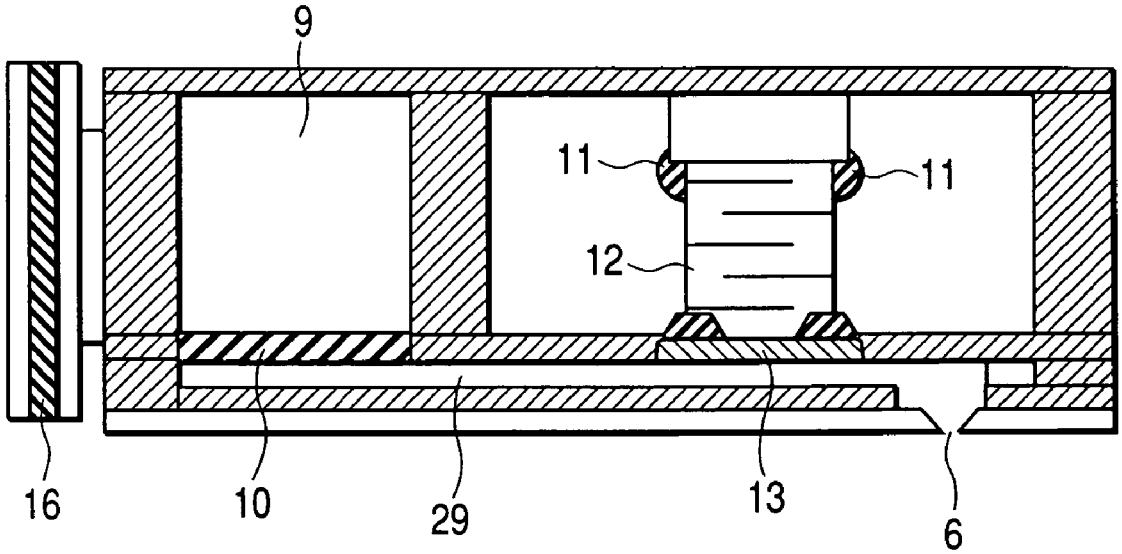
FIGS. 3A and 3B are a schematic cross sectional elevational view and a schematic cross sectional plane view, respectively, of an embodiment of an ink-jet head according to the invention.
Figure 3B:
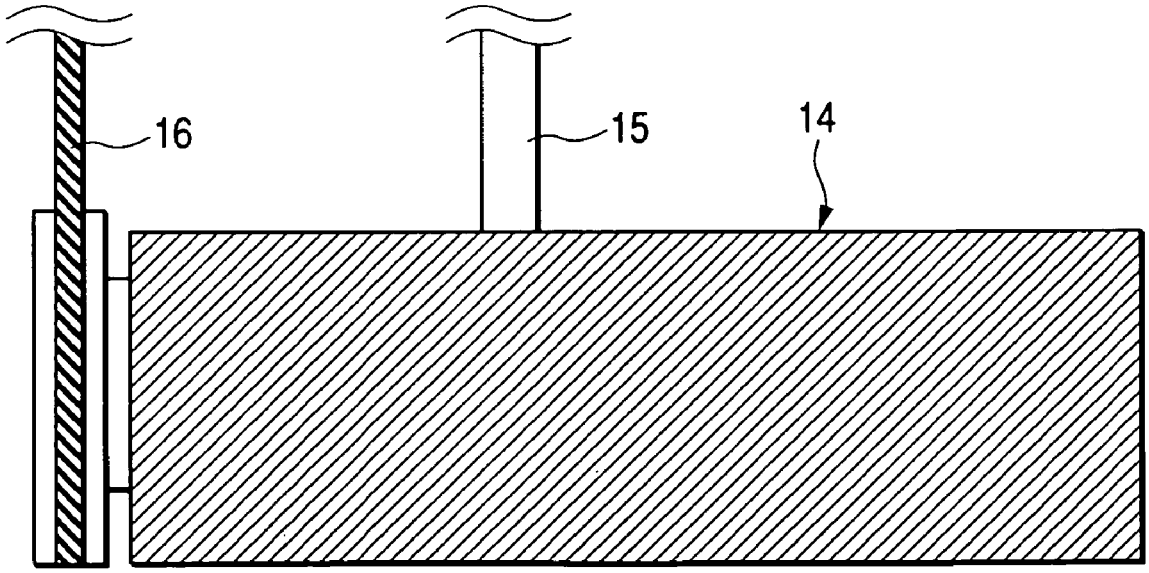

FIGS. 3A and 3B are a schematic cross sectional elevational view and a schematic cross sectional plane view, respectively, of an embodiment of an ink-jet head, to which the invention is applied.

An ink is charged in a common ink chamber 9 from an ink tank (not shown in the figures) through an ink feeding pipe (not shown in the figures). The ink charged in the common ink chamber 9 is filtered through an ink filter 10 and charged in an individual ink chamber 29. The individual ink chamber 29 is equipped on a part thereof with a driving element, such as a piezoelectric element and a heater element, and the volume of the interior of the individual ink chamber 29 is changed with the driving element, whereby the ink charged in the individual ink chamber 29 is ejected as ink droplets. In this embodiment, a piezoelectric element is used as the driving element. In FIGS. 3A and 3B, the ink is ejected through the following steps. A driving pulse based on a driving signal sent from an apparatus, such as a personal computer, (not shown in the figures) is applied an electrode 11. A piezoelectric element 12 is contracted or expanded by the driving pulse, and the displacement caused thereby displaces a diaphragm 13, which is a part of the individual ink chamber 29 and is provided in contact with the piezoelectric element 12, so as to change the volume of the individual ink chamber 29, whereby the ink charged in the individual ink chamber 29 is ejected through an orifice opening 6.

The ink-jet head 14 ejects an ink while it moves along a guide rail 15. The ink-jet head 14 is moved with a belt 16.

2.3 Ink-jet Printer

Figure 4A:
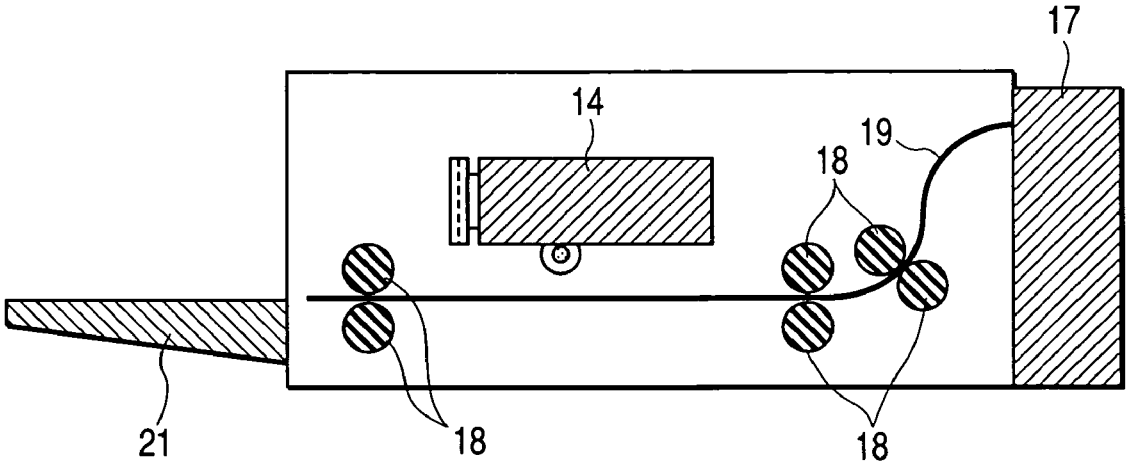
FIGS. 4A and 4B are a schematic cross sectional elevational view and a schematic cross sectional plane view, respectively, of an embodiment of an ink-jet printer according to the invention.
Figure 4B:
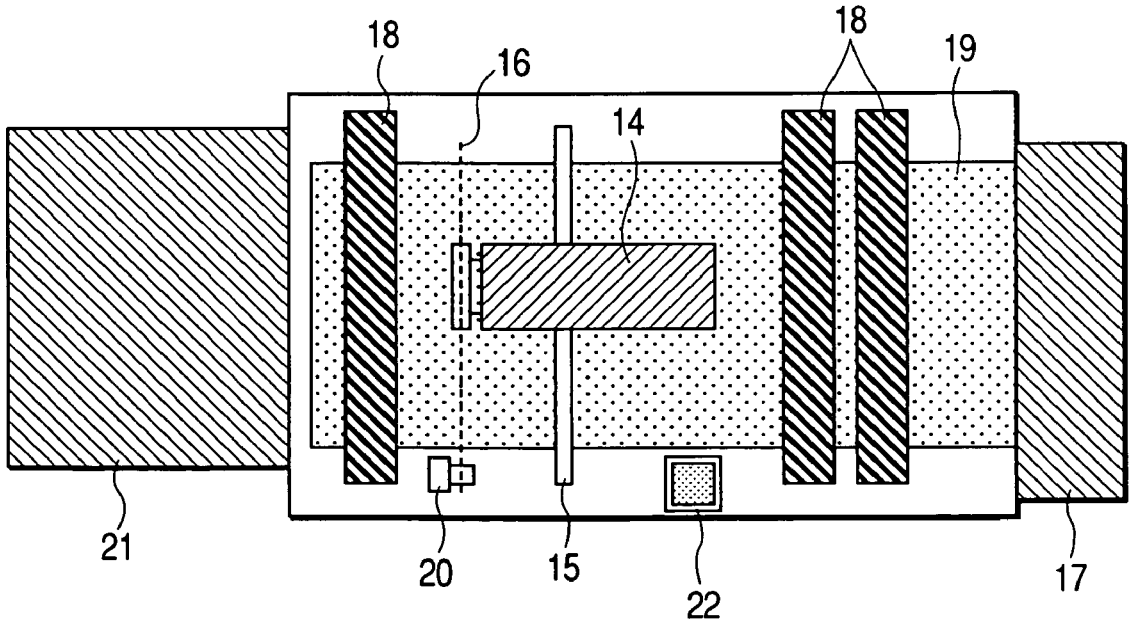

FIGS. 4A and 4B are a schematic cross sectional elevational view and a schematic cross sectional plane view, respectively, of an embodiment of an ink-jet printer of the invention.

Paper 19 is conveyed with conveying rollers 18 from a paper feeding device 17. An ink-jet head 14 is disposed to face the paper 19. The ink-jet head 14 is constituted to be moved on a guide rail 15 with a belt driving motor 20 through a belt 16. The ink-jet head 14 appropriately ejects an ink on the paper 19 at a prescribed timing based on detection of a paper position sensor (not shown in the figures) and a position sensor of the head, so as to form an image on the paper 19. The paper 19 having an image thus formed is conveyed to a paper receiving tray 21. A maintenance mechanism 22 is provided in the non-printing area of the printer for removing an ink attached to the orifice plate of the ink-jet head 14 and for preventing deterioration in reliability due to ink ejection failure. The maintenance mechanism 22 contains therein a purge mechanism (not shown in the figures) and a wiping mechanism (not shown in the figures) containing a silicone rubber plate or the like. The orifice surface is wiped with the maintenance mechanism 22 to remove the unnecessary ink attached in the vicinity of the orifice opening.

EXAMPLES

The invention will be described in more detail with reference to the following examples, but the scope of the invention is not construed as being limited to the examples.

Example 1

1. Formation of Water Repellent Film (1) Formation of Fluorine-containing Polymer Resin Layer Cytop (Model CTL-107M, produced by Asahi Glass Co., Ltd., available as a 7% by weight solution) as a fluorine-containing polymer resin was diluted with the dedicated solvent to a concentration of 1% by weight to obtain a solution. The solution was coated on four SUS304 plates each having a length of 50 mm, a width of 15 mm and a thickness of 80 μm by the dip method and heated to 120° C. for 1 hour to form a water repellent film formed with Cytop on the surface of the SUS304 plates. The updrawing speed of the SUS304 plates for an orifice plate was 10 mm/sec.

(2) Irradiation with Oxygen Plasma

The plates having the fluorine-containing polymer resin layer formed thereon were irradiated with oxygen plasma. The apparatus used for irradiation was Plasma Dry Cleaner PDC-210, produced by Yamato Glass Co., Ltd. The output electric power of a high frequency power source of the apparatus was 100 W upon irradiation. The irradiation time for the four plates was 0 (i.e., not irradiating with oxygen plasma), 100 seconds, 300 seconds or 1,000 seconds, respectively.

(3) Formation of Perfluoropolyether Layer or Perfluoroalkyl Layer

After irradiation, the plates were immediately immersed in a solution of Compound 1 dissolved in HFE-7200 (a fluorine solvent, produced by 3M Corp.) of a concentration of 0.1% by weight for 1 hour. The four SUS plates were updrawn from the solution and heated at 120° C. for 10 minutes. After cooling the heated SUS plates to ordinary temperature, they were rinsed with HFE-7200 to remove excessive Compound 1. Test pieces formed with SUS304 each having a water repellent film according to the invention were obtained by the aforementioned process. The test piece that had not been irradiated with oxygen plasma had no hydroxyl group on the surface thereof, and therefore, a perfluoropolyether layer derived from Compound 1 was simply attached to the fluorine-containing polymer resin layer without bonding.

For comparison, another test piece was produced by forming no fluorine-containing polymer layer formed with Cytop but carrying out the other process steps (i.e., the irradiation of oxygen plasma and the formation of a perfluoropolyether layer).

Evaluation (a) Measurement of Initial Contact Angle

In order to evaluate the water repelling property of the water repellent films formed on the test pieces, contact angles thereof with an UV curing ink are shown in Table 1 below. The UV curing ink used herein was produced by mixing 84 parts by weight of ethyl acrylate, 5 parts by weight of 2,4,6-trimethylbenzoylphosphine oxide, 1 part by weight of benzophenone and 10 parts by weight of carbon black having an average particle diameter of 0.1 μm in a planetary ball mill.

TABLE 1

Evaluation Results of Water Repellent Film of the Invention (using Compound 1)

| | | Plasma irradiation time upon forming film (sec) | | | |
|---|---|---|---|---|---|
| | | 0 | 100 | 300 | 1,000 |
| Initial contact angle (deg) | with water | 110 | 118 | 120 | 120 |
| | with UV curing ink | 54 | 60 | 65 | 67 |
| Contact angle after rubbing test (deg) | | 30 | 55 | 56 | 57 |
| Contact angle after immersion test (deg) | | 46 | 55 | 57 | 57 |

For reference, contact angles with water were also indicated in Table 1. These contact angles are indicated as initial contact angles in Table 1.

As demonstrated by the results shown in Table 1, the test pieces having the Cytop layer and being irradiated with oxygen plasma exhibited a contact angle of from 118 to 120° with water and from 60 to 67° with the UV curing ink. The test piece not being irradiated with oxygen plasma exhibited a contact angle of 110° with water and 54° wit the UV curing ink.

The test piece having no layer formed with Cytop but having a water repellent layer derived from Compound 1 was also evaluated in the same manner. The results are shown in Table 2 below.

TABLE 2

Evaluation Results of Water Repellent Film formed only with Compound 1

| | | Plasma irradiation time upon forming film (sec) | | | |
|---|---|---|---|---|---|
| | | 0 | 100 | 300 | 1,000 |
| Initial contact angle (deg) | with water | 118 | 118 | 120 | 120 |
| | with UV curing ink | 58 | 60 | 65 | 67 |
| Contact angle after rubbing test (deg) | | ≦20 | ≦20 | 32 | 36 |
| Contact angle after immersion test (deg) | | ≦20 | ≦20 | 30 | 36 |

The test piece having no layer formed with Cytop but simply having a water repellent layer derived from Compound 1 exhibited a contact angle of from 118 to 120° with water and from 58 to 67° with the UV curing ink.

(b) Rubbing Test

The water repellent film formed on the test piece was rubbed with a silicone rubber sheet having a size of 20 mm square and a thickness of 2 mm, and changes in contact angle were evaluated. A reciprocal rubbing operation was carried out 50,000 times at a pressure of 100 g/cm$^2$, a rubbing velocity of 10 mm/sec and a rubbing length of 10 mm, and one drop (50 μL) of the UV curing ink was dropped on the silicone rubber sheet per 10 times of the rubbing operations. After completing the rubbing operation 50,000 times, the contact angle of the water repellent film was measured. The results obtained are shown in Table 1.

As demonstrated by the results shown in Table 1, the test pieces having the Cytop layer and being irradiated with oxygen plasma exhibited a contact angle of 50° or more (from 55 to 57°) even after the rubbing operation 50,000 times. However, the test piece not being irradiated with oxygen plasma exhibited a contact angle decreasing to 30°. It has been demonstrated from the results that in order to improve the abrasion resistance, it is necessary that hydroxyl groups are formed by irradiating the fluorine-containing polymer resin layer with oxygen plasma, and the part having a perfluoropolyether chain is bonded thereto.

The results of the test piece having no layer formed with Cytop but having only a water repellent layer derived from Compound 1 was also evaluated in the same manner. The results are shown in Table 2. The water repellent films exhibited a contact angle of from 58 to 67° in the initial state (before rubbing), but the contact angles thereof were decreased to less than 40° (from 20° or less to 36°) after rubbing. It has been demonstrated from the results that in order to improve the abrasion resistance, it is insufficient that the part having a perfluoropolyether chain is bonded to form a water repellent film, but it is necessary to provide the composite film with the fluorine-containing polymer resin layer.

(c) Immersion Test

The test pieces were immersed in the UV curing ink for 30 days, and the contact angles after immersion were measured. The results are shown in Table 1. The test pieces having the Cytop layer and being irradiated with oxygen plasma exhibited a contact angle of 50° or more (from 55 to 57°) even after immersion for 30 days. However, the test piece not being irradiated with oxygen plasma exhibited a contact angle decreasing to less than 50° (46°). It has been demonstrated from the results that in order to improve the immersion resistance, it is necessary that the part having a perfluoropolyether chain is bonded to the fluorine-containing polymer resin layer.

The results of the test piece having no layer formed with Cytop but having only a water repellent layer derived from Compound 1 was also evaluated in the same manner. The results are shown in Table 2. The water repellent films exhibited a contact angle being decreased to less than 40° (from 20° or less to 36°) after immersion. It has been demonstrated from the results that in order to improve the immersion resistance, it is insufficient that the part having a perfluoropolyether chain is bonded to form a water repellent film, but it is necessary to provide the composite film with the fluorine-containing polymer resin layer.

Example 2

Test pieces were produced in the same manner as in Example 1 except that Compound 2 was used instead of Compound 1. The test pieces were subjected to the measurement of initial contact angles and contact angles after the rubbing test and the immersion test in the same manner as in Example 1. The results are shown in Table 3 below.

TABLE 3

Evaluation Results of Water Repellent Film of the Invention (using Compound 2)

| | | Plasma irradiation time upon forming film (sec) | | | |
|---|---|---|---|---|---|
| | | 0 | 100 | 300 | 1,000 |
| Initial contact angle (deg) | with water | 110 | 118 | 120 | 120 |
| | with UV curing ink | 54 | 60 | 65 | 67 |
| Contact angle after rubbing test (deg) | | 30 | 55 | 57 | 57 |
| Contact angle after immersion test (deg) | | 46 | 55 | 57 | 57 |

The test pieces having the fluorine-containing polymer resin layer formed with Cytop and being irradiated with oxygen plasma exhibited a contact angle of 50° or more (from 56 to 57°) even after the rubbing operation 50,000 times. However, the test piece not being irradiated with oxygen plasma exhibited a contact angle decreasing to 30°. It has been demonstrated from the results that in order to improve the abrasion resistance, it is necessary that the part having a perfluoropolyether chain is bonded to the fluorine-containing polymer resin layer.

A test piece having no fluorine-containing polymer resin layer formed with Cytop but only having a water repellent layer derived from Compound 2 was also evaluated in the same manner. The results are shown in Table 4 below.

TABLE 4

Evaluation Results of Water Repellent Film formed only with Compound 2

| | | Plasma irradiation time upon forming film (sec) | | | |
|---|---|---|---|---|---|
| | | 0 | 100 | 300 | 1,000 |
| Initial contact angle (deg) | with water | 118 | 118 | 120 | 120 |
| | with UV curing ink | 58 | 60 | 65 | 67 |
| Contact angle after rubbing test (deg) | | ≦20 | ≦20 | 32 | 36 |
| Contact angle after immersion test (deg) | | ≦20 | ≦20 | 30 | 36 |

The water repellent films exhibited a contact angle of from 58 to 67° in the initial state, but the contact angles thereof were decreased to less than 40° (from 20° or less to 36°) after rubbing. It has been demonstrated from the results that in order to improve the abrasion resistance, it is insufficient that the part having a perfluoropolyether chain is bonded to form a water repellent film, but it is necessary to provide the composite film with the fluorine-containing polymer resin layer.

The test pieces were immersed in the UV curing ink for 30 days, and the contact angles after immersion were measured. The results are shown in Table 3. The test pieces having the Cytop layer as the fluorine-containing polymer resin layer and being irradiated with oxygen plasma exhibited a contact angle of 50° or more (from 55 to 57°) even after immersion for 30 days. However, the test piece not being irradiated with oxygen plasma exhibited a contact angle decreasing to less than 50° (46°). It has been demonstrated from the results that in order to improve the immersion resistance, it is necessary that the part having a perfluoropolyether chain is bonded to the fluorine-containing polymer resin layer.

The results of the test piece having no fluorine-containing polymer resin layer formed with Cytop but having only a water repellent layer derived from Compound 2 was also evaluated in the same manner. The results are shown in Table 4. The water repellent films exhibited a contact angle being decreased to less than 40° (from 20° or less to 36°) after immersion. It has been demonstrated from the results that in order to improve the immersion resistance, it is insufficient that the part having a perfluoropolyether chain is bonded to form a water repellent film, but it is necessary to provide the composite film with the fluorine-containing polymer resin layer.

Example 3

Test pieces were produced in the same manner as in Example 1 except that Compound 3 was used instead of Compound 1. The test pieces were subjected to the measurement of initial contact angles and contact angles after the rubbing test and the immersion test in the same manner as in Example 1. The results are shown in Table 5 below.

TABLE 5

Evaluation Results of Water Repellent Film of the Invention (using Compound 3)

| | | Plasma irradiation time upon forming film (sec) | | | |
|---|---|---|---|---|---|
| | | 0 | 100 | 300 | 1,000 |
| Initial contact angle (deg) | with water | 110 | 120 | 121 | 122 |
| | with UV curing ink | 54 | 62 | 66 | 68 |
| Contact angle after rubbing test (deg) | | 30 | 56 | 57 | 58 |
| Contact angle after immersion test (deg) | | 46 | 56 | 58 | 58 |

The test pieces having the Cytop layer and being irradiated with oxygen plasma exhibited a contact angle of 50° or more (from 56 to 58°) even after the rubbing operation 50,000 times. However, the test piece not being irradiated with oxygen plasma exhibited a contact angle decreasing to 30°. It has been demonstrated from the results that in order to improve the abrasion resistance, it is necessary that the part having a perfluoropolyether chain is bonded to the fluorine-containing polymer resin layer.

A test piece having no fluorine-containing polymer resin layer formed with Cytop but only having a water repellent layer derived from Compound 3 was also evaluated in the same manner. The results are shown in Table 6 below.

TABLE 6

Evaluation Results of Water Repellent Film formed only with Compound 3

| | | Plasma irradiation time upon forming film (sec) | | | |
|---|---|---|---|---|---|
| | | 0 | 100 | 300 | 1,000 |
| Initial contact angle (deg) | with water | 120 | 120 | 121 | 122 |
| | with UV curing ink | 60 | 62 | 66 | 68 |
| Contact angle after rubbing test (deg) | | ≦20 | ≦20 | 36 | 38 |
| Contact angle after immersion test (deg) | | ≦20 | ≦20 | 32 | 34 |

The water repellent films exhibited a contact angle of from 60 to 68° in the initial state, but the contact angles thereof were decreased to less than 40° (from 20° or less to 38°) after rubbing. It has been demonstrated from the results that in order to improve the abrasion resistance, it is insufficient that the part having a perfluoropolyether chain is bonded to form a water repellent film, but it is necessary to provide the composite film with the fluorine-containing polymer resin layer.

The test pieces were immersed in the UV curing ink for 30 days, and the contact angles after immersion were measured. The results are shown in Table 5. The test pieces having the Cytop layer and being irradiated with oxygen plasma exhibited a contact angle of 50° or more (from 56 to 58°) even after immersion for 30 days. However, the test piece not being irradiated with oxygen plasma exhibited a contact angle decreasing to less than 50° (46°). It has been demonstrated from the results that in order to improve the immersion resistance, it is necessary that the part having a perfluoropolyether chain is bonded to the fluorine-containing polymer resin layer.

The results of the test piece having no layer formed with Cytop but having only a water repellent layer derived from Compound 3 was also evaluated in the same manner. The results are shown in Table 6. The water repellent films exhibited a contact angle being decreased to less than 40° (from 20° or less to 34°) after immersion. It has been demonstrated from the results that in order to improve the immersion resistance, it is insufficient that the part having a perfluoropolyether chain is bonded to form a water repellent film, but it is necessary to provide the composite film with the fluorine-containing polymer resin layer.

Example 4

Test pieces were produced in the same manner as in Example 1 except that Compound 4 was used instead of Compound 1. The test pieces were subjected to the measurement of initial contact angles and contact angles after the rubbing test and the immersion test in the same manner as in Example 1. The results are shown in Table 7 below.

TABLE 7

Evaluation Results of Water Repellent Film of the Invention (using Compound 4)

| | | Plasma irradiation time upon forming film (sec) | | | |
|---|---|---|---|---|---|
| | | 0 | 100 | 300 | 1,000 |
| Initial contact angle (deg) | with water | 110 | 120 | 121 | 122 |
| | with UV curing ink | 54 | 62 | 66 | 68 |
| Contact angle after rubbing test (deg) | | 30 | 56 | 58 | 58 |
| Contact angle after immersion test (deg) | | 46 | 56 | 58 | 58 |

The test pieces having the Cytop layer and being irradiated with oxygen plasma exhibited a contact angle of 50° or more (from 56 to 58°) even after the rubbing operation 50,000 times. However, the test piece not being irradiated with oxygen plasma exhibited a contact angle decreasing to 30°. It has been demonstrated from the results that in order to improve the abrasion resistance, it is necessary that the part having a perfluoropolyether chain is bonded to the fluorine-containing polymer resin layer.

A test piece having no fluorine-containing polymer resin layer formed with Cytop but only having a water repellent layer derived from Compound 4 was also evaluated in the same manner. The results are shown in Table 8 below.

TABLE 8

Evaluation Results of Water Repellent Film formed only with Compound 4

| | | Plasma irradiation time upon forming film (sec) | | | |
|---|---|---|---|---|---|
| | | 0 | 100 | 300 | 1,000 |
| Initial contact angle (deg) | with water | 120 | 120 | 121 | 122 |
| | with UV curing ink | 60 | 62 | 66 | 68 |
| Contact angle after rubbing test (deg) | | ≦20 | ≦20 | 36 | 38 |
| Contact angle after immersion test (deg) | | ≦20 | ≦20 | 32 | 34 |

The water repellent films exhibited a contact angle of from 58 to 67° in the initial state, but the contact angles thereof were decreased to less than 40° (from 20° or less to 38°) after rubbing. It has been demonstrated from the results that in order to improve the abrasion resistance, it is insufficient that the part having a perfluoropolyether chain is bonded to form a water repellent film, but it is necessary to provide the composite film with the fluorine-containing polymer resin layer.

The test pieces were immersed in the UV curing ink for 30 days, and the contact angles after immersion were measured. The results are shown in Table 7. The test pieces having the Cytop layer and being irradiated with oxygen plasma exhibited a contact angle of 50° or more (from 56 to 58°) even after immersion for 30 days. However, the test piece not being irradiated with oxygen plasma exhibited a contact angle decreasing to less than 50° (46°). It has been demonstrated from the results that in order to improve the immersion resistance, it is necessary that the part having a perfluoropolyether chain is bonded to the fluorine-containing polymer resin layer.

The results of the test piece having no layer formed with Cytop but having only a water repellent layer derived from Compound 4 was also evaluated in the same manner. The results are shown in Table 8. The water repellent films exhibited a contact angle being decreased to less than 40° (from 20° or less to 34°) after immersion. It has been demonstrated from the results that in order to improve the immersion resistance, it is insufficient that the part having a perfluoropolyether chain is bonded to form a water repellent film, but it is necessary to provide the composite film with the fluorine-containing polymer resin layer.

Example 5

Test pieces were produced in the same manner as in Example 1 except that Compound 5 was used instead of Compound 1. The test pieces were subjected to the measurement of initial contact angles and contact angles after the rubbing test and the immersion test in the same manner as in Example 1. The results are shown in Table 9 below.

TABLE 9

Evaluation Results of Water Repellent Film of the Invention (using Compound 5)

| | | Plasma irradiation time upon forming film (sec) | | | |
|---|---|---|---|---|---|
| | | 0 | 100 | 300 | 1,000 |
| Initial contact angle (deg) | with water | 110 | 121 | 122 | 122 |
| | with UV curing ink | 54 | 63 | 67 | 68 |
| Contact angle after rubbing test (deg) | | 30 | 56 | 58 | 58 |
| Contact angle after immersion test (deg) | | 46 | 56 | 58 | 58 |

The test pieces having the Cytop layer and being irradiated with oxygen plasma exhibited a contact angle of 50° or more (from 56 to 58°) even after the rubbing operation 50,000 times. However, the test piece not being irradiated with oxygen plasma exhibited a contact angle decreasing to 30°. It has been demonstrated from the results that in order to improve the abrasion resistance, it is necessary that the part having a perfluoropolyether chain is bonded to the fluorine-cotaining polymer resin layer.

A test piece having no fluorine-containing polymer resin layer formed with Cytop but only having a water repellent layer derived from Compound 5 was also evaluated in the same manner. The results are shown in Table 10 below.

TABLE 10

Evaluation Results of Water Repellent Film formed only with Compound 5

| | | Plasma irradiation time upon forming film (sec) | | | |
|---|---|---|---|---|---|
| | | 0 | 100 | 300 | 1,000 |
| Initial contact angle (deg) | with water | 120 | 120 | 121 | 122 |
| | with UV curing ink | 60 | 62 | 67 | 68 |
| Contact angle after rubbing test (deg) | | ≦20 | ≦20 | 37 | 38 |
| Contact angle after immersion test (deg) | | ≦20 | ≦20 | 33 | 34 |

The water repellent films exhibited a contact angle of from 62 to 68° in the initial state, but the contact angles thereof were decreased to less than 40° (from 20° or less to 38°) after rubbing. It has been demonstrated from the results that in order to improve the abrasion resistance, it is insufficient that the part having a perfluoropolyether chain is bonded to form a water repellent film, but it is necessary to provide the composite film with the fluorine-containing polymer resin layer.

The test pieces were immersed in the UV curing ink for 30 days, and the contact angles after immersion were measured. The results are shown in Table 9. The test pieces having the Cytop layer and being irradiated with oxygen plasma exhibited a contact angle of 50° or more (from 56 to 58°) even after immersion for 30 days. However, the test piece not being irradiated with oxygen plasma exhibited a contact angle decreasing to less than 50°(46°). It has been demonstrated from the results that in order to improve the immersion resistance, it is necessary that the part having a perfluoropolyether chain is bonded to the fluorine-containing polymer resin layer.

The results of the test piece having no layer formed with Cytop but having only a water repellent layer derived from Compound 5 was also evaluated in the same manner. The results are shown in Table 10. The water repellent films exhibited a contact angle being decreased to less than 40° (from 20° or less to 34°) after immersion. It has been demonstrated from the results that in order to improve the immersion resistance, it is insufficient that the part having a perfluoropolyether chain is bonded to form a water repellent film, but it is necessary to provide the composite film with the fluorine-containing polymer resin layer.

Example 6

Test pieces were produced in the same manner as in Example 1 except that Compound 6 was used instead of Compound 1. The test pieces were subjected to the measurement of initial contact angles and contact angles after the rubbing test and the immersion test in the same manner as in Example 1. The results are shown Table 11 below.

TABLE 11

Evaluation Results of Water Repellent Film of the Invention (using Compound 6)

| | | Plasma irradiation time upon forming film (sec) | | | |
|---|---|---|---|---|---|
| | | 0 | 100 | 300 | 1,000 |
| Initial contact angle (deg) | with water | 110 | 121 | 122 | 122 |
| | with UV curing ink | 54 | 63 | 67 | 68 |
| Contact angle after rubbing test (deg) | | 30 | 56 | 58 | 59 |
| Contact angle after immersion test (deg) | | 46 | 56 | 58 | 58 |

The test pieces having the Cytop layer and being irradiated with oxygen plasma exhibited a contact angle of 50° or more (from 56 to 59°) even after the rubbing operation 50,000 times. However, the test piece not being irradiated with oxygen plasma exhibited a contact angle decreasing to 30°. It has been demonstrated from the results that in order to improve the abrasion resistance, it is necessary that the part having a perfluoropolyether chain is bonded to the fluorine-containing polymer resin layer.

A test piece having no fluorine-containing polymer resin layer formed with Cytop but only having a water repellent layer derived from Compound 6 was also evaluated in the same manner. The results are shown in Table 12 below.

TABLE 12

Evaluation Results of Water Repellent Film formed only with Compound 6

| | | Plasma irradiation time upon forming film (sec) | | | |
|---|---|---|---|---|---|
| | | 0 | 100 | 300 | 1,000 |
| Initial contact angle (deg) | with water | 120 | 120 | 121 | 122 |
| | with UV curing ink | 60 | 62 | 67 | 68 |
| Contact angle after rubbing test (deg) | | ≦20 | ≦20 | 37 | 38 |
| Contact angle after immersion test (deg) | | ≦20 | ≦20 | 33 | 34 |

The water repellent films exhibited a contact angle of from 60 to 68° in the initial state, but the contact angles thereof were decreased to less than 40° (from 20° or less to 38°) after rubbing. It has been demonstrated from the results that in order to improve the abrasion resistance, it is insufficient that the part having a perfluoropolyether chain is bonded to form a water repellent film, but it is necessary to provide the composite film with the fluorine-containing polymer resin layer.

The test pieces were immersed in the UV curing ink for 30 days, and the contact angles after immersion were measured. The results are shown in Table 11. The test pieces having the Cytop layer and being irradiated with oxygen plasma exhibited a contact angle of 50° or more (from 56 to 58°) even after immersion for 30 days. However, the test piece not being irradiated with oxygen plasma exhibited a contact angle decreasing to less than 50° (46°). It has been demonstrated from the results that in order to improve the immersion resistance, it is necessary that the part having a perfluoropolyether chain is bonded to the fluorine-containing polymer resin layer.

The results of the test piece having no layer formed with Cytop but having only a water repellent layer derived from Compound 6 was also evaluated in the same manner. The results are shown in Table 12. The water repellent films exhibited a contact angle being decreased to less than 40° (from 20° or less to 34°) after immersion. It has been demonstrated from the results that in order to improve the immersion resistance, it is insufficient that the part having a perfluoropolyether chain is bonded to form a water repellent film, but it is necessary to provide the composite film with the fluorine-containing polymer resin layer.

Example 7

Test pieces were produced in the same manner as in Example 1 except that Compound 7 was used instead of Compound 1. The test pieces were subjected to the measurement of initial contact angles and contact angles after the rubbing test and the immersion test in the same manner as in Example 1. The results are shown in Table 13 below.

TABLE 13

Evaluation Results of Water Repellent Film of the Invention (using Compound 7)

| | | Plasma irradiation time upon forming film (sec) | | | |
|---|---|---|---|---|---|
| | | 0 | 100 | 300 | 1,000 |
| Initial contact angle (deg) | with water | 110 | 121 | 122 | 122 |
| | with UV curing ink | 54 | 63 | 68 | 68 |
| Contact angle after rubbing test (deg) | | 30 | 57 | 58 | 59 |
| Contact angle after immersion test (deg) | | 46 | 57 | 58 | 59 |

The test pieces having the Cytop layer and being irradiated with oxygen plasma exhibited a contact angle of 50° or more (from 57 to 59°) even after the rubbing operation 50,000 times. However, the test piece not being irradiated with oxygen plasma exhibited a contact angle decreasing to 30°. It has been demonstrated from the results that in order to improve the abrasion resistance, it is necessary that the part having a perfluoropolyether chain is bonded to the fluorine-containing polymer resin layer.

A test piece having no fluorine-containing polymer resin layer formed with Cytop but only having a water repellent layer derived from Compound 7 was also evaluated in the same manner. The results are shown in Table 14 below.

TABLE 14

Evaluation Results of Water Repellent Film formed only with Compound 7

| | | Plasma irradiation time upon forming film (sec) | | | |
|---|---|---|---|---|---|
| | | 0 | 100 | 300 | 1,000 |
| Initial contact angle (deg) | with water | 120 | 121 | 122 | 122 |
| | with UV curing ink | 60 | 63 | 68 | 68 |
| Contact angle after rubbing test (deg) | | ≦20 | ≦20 | 37 | 38 |
| Contact angle after immersion test (deg) | | ≦20 | ≦20 | 34 | 34 |

The water repellent films exhibited a contact angle of from 60 to 68° in the initial state, but the contact angles thereof were decreased to less than 40° (from 20° or less to 38°) after rubbing. It has been demonstrated from the results that in order to improve the abrasion resistance, it is insufficient that the part having a perfluoropolyether chain is bonded to form a water repellent film, but it is necessary to provide the composite film with the fluorine-containing polymer resin layer.

The test pieces were immersed in the UV curing ink for 30 days, and the contact angles after immersion were measured. The results are shown in Table 13. The test pieces having the Cytop layer and being irradiated with oxygen plasma exhibited a contact angle of 50° or more (from 57 to 59°) even after immersion for 30 days. However, the test piece not being irradiated with oxygen plasma exhibited a contact angle decreasing to less than 50° (46°). It has been demonstrated from the results that in order to improve the immersion resistance, it is necessary that the part having a perfluoropolyether chain is bonded to the fluorine-containing polymer resin layer.

The results of the test piece having no layer formed with Cytop but having only a water repellent layer derived from Compound 7 was also evaluated in the same manner. The results are shown in Table 14. The water repellent films exhibited a contact angle being decreased to less than 40° (from 20° or less to 34°) after immersion. It has been demonstrated from the results that in order to improve the immersion resistance, it is insufficient that the part having a perfluoropolyether chain is bonded to form a water repellent film, but it is necessary to provide the composite film with the fluorine-containing polymer resin layer.

Example 8

Test pieces were produced in the same manner as in Example 1 except that Compound 8 was used instead of Compound 1. The test pieces were subjected to the measurement of initial contact angles and contact angles after the rubbing test and the immersion test in the same manner as in Example 1. The results are shown in Table 15 below.

TABLE 15

Evaluation Results of Water Repellent Film of the Invention (using Compound 8)

| | | Plasma irradiation time upon forming film (sec) | | | |
|---|---|---|---|---|---|
| | | 0 | 100 | 300 | 1,000 |
| Initial contact angle (deg) | with water | 110 | 121 | 122 | 122 |
| | with UV curing ink | 54 | 63 | 68 | 68 |
| Contact angle after rubbing test (deg) | | 30 | 57 | 59 | 59 |
| Contact angle after immersion test (deg) | | 46 | 57 | 58 | 59 |

The test pieces having the Cytop layer and being irradiated with oxygen plasma exhibited a contact angle of 50° or more (from 57 to 59°) even after the rubbing operation 50,000 times. However, the test piece not being irradiated with oxygen plasma exhibited a contact angle decreasing to 30°. It has been demonstrated from the results that in order to improve the abrasion resistance, it is necessary that the part having a perfluoropolyether chain is bonded to the fluorine-containing polymer resin layer.

A test piece having no fluorine-containing polymer resin layer formed with Cytop but only having a water repellent layer derived from Compound 8 was also evaluated in the same manner. The results are shown in Table 16 below.

TABLE 16

Evaluation Results of Water Repellent Film formed only with Compound 8

| | | Plasma irradiation time upon forming film (sec) | | | |
|---|---|---|---|---|---|
| | | 0 | 100 | 300 | 1,000 |
| Initial contact angle (deg) | with water | 120 | 121 | 122 | 122 |
| | with UV curing ink | 60 | 63 | 68 | 68 |
| Contact angle after rubbing test (deg) | | ≦20 | ≦20 | 37 | 38 |
| Contact angle after immersion test (deg) | | ≦20 | ≦20 | 34 | 34 |

The water repellent films exhibited a contact angle of from 60 to 68° in the initial state, but the contact angles thereof were decreased to less than 40° (from 20° or less to 38°) after rubbing. It has been demonstrated from the results that in order to improve the abrasion resistance, it is insufficient that the part having a perfluoropolyether chain is bonded to form a water repellent film, but it is necessary to provide the composite film with the fluorine-containing polymer resin layer.

The test pieces were immersed in the UV curing ink for 30 days, and the contact angles after immersion were measured. The results are shown in Table 15. The test pieces having the Cytop layer and being irradiated with oxygen plasma exhibited a contact angle of 50° or more (from 57 to 59°) even after immersion for 30 days. However, the test piece not being irradiated with oxygen plasma exhibited a contact angle decreasing to less than 50° (46°). It has been demonstrated from the results that in order to improve the immersion resistance, it is necessary that the part having a perfluoropolyether chain is bonded to the fluorine-containing polymer resin layer.

The results of the test piece having no layer formed with Cytop but having only a water repellent layer derived from Compound 8 was also evaluated in the same manner. The results are shown in Table 16. The water repellent films exhibited a contact angle being decreased to less than 40° (from 20° or less to 34°) after immersion. It has been demonstrated from the results that in order to improve the immersion resistance, it is insufficient that the part having a perfluoropolyether chain is bonded to form a water repellent film, but it is necessary to provide the composite film with the fluorine-containing polymer resin layer.

Example 9

Test pieces were produced in the same manner as in Example 1 except that the following Compound 9 was used instead of Compound 1.

$$F(CF_2)_6—(CH_2)_2—Si(OCH_2CH_3)_3 \qquad \text{Compound 9}$$

The test pieces were subjected to the measurement of initial contact angles and contact angles after the rubbing test and the immersion test in the same manner as in Example 1. The results are shown in Table 17 below.

TABLE 17

Evaluation Results of Water Repellent Film of the Invention (using Compound 9)

| | | Plasma irradiation time upon forming film (sec) | | | |
|---|---|---|---|---|---|
| | | 0 | 100 | 300 | 1,000 |
| Initial contact angle (deg) | with water | 110 | 111 | 113 | 114 |
| | with UV curing ink | 54 | 54 | 55 | 56 |
| Contact angle after rubbing test (deg) | | 30 | 50 | 51 | 52 |
| Contact angle after immersion test (deg) | | 46 | 50 | 51 | 51 |

The test pieces having the Cytop layer and being irradiated with oxygen plasma exhibited a contact angle of 50° or more (from 50 to 52°) even after the rubbing operation 50,000 times. However, the test piece not being irradiated with oxygen plasma exhibited a contact angle decreasing to 30°. It has been demonstrated from the results that in order to improve the abrasion resistance, it is necessary that the part having a perfluoroalkyl chain is bonded to the fluorine-containing polymer resin layer.

A test piece having no fluorine-containing polymer resin layer formed with Cytop but only having a water repellent layer derived from Compound 9 was also evaluated in the same manner. The results are shown in Table 18 below.

TABLE 18

Evaluation Results of Water Repellent Film formed only with Compound 9

| | | Plasma irradiation time upon forming film (sec) | | | |
|---|---|---|---|---|---|
| | | 0 | 100 | 300 | 1,000 |
| Initial contact angle (deg) | with water | 113 | 114 | 115 | 115 |
| | with UV curing ink | 55 | 56 | 57 | 57 |
| Contact angle after rubbing test (deg) | | ≦20 | ≦20 | ≦20 | ≦20 |
| Contact angle after immersion test (deg) | | ≦20 | ≦20 | ≦20 | ≦20 |

The water repellent films exhibited a contact angle of from 55 to 57° in the initial state, but the contact angles thereof were decreased to 20° or less after rubbing. It has been demonstrated from the results that in order to improve the abrasion resistance, it is insufficient that the part having a perfluoroalkyl chain is bonded to form a water repellent film, but it is necessary to provide the composite film with the fluorine-containing polymer resin layer.

The test pieces were immersed in the UV curing ink for 30 days, and the contact angles after immersion were measured. The results are shown in Table 17. The test pieces having the Cytop layer and being irradiated with oxygen plasma exhibited a contact angle of 50° or more (from 50 to 51°) even after immersion for 30 days. However, the test piece not being irradiated with oxygen plasma exhibited a contact angle decreasing to less than 50° (46°). It has been demonstrated from the results that in order to improve the immersion resistance, it is necessary that the part having a perfluoroalkyl chain is bonded to the fluorine-containing polymer resin layer.

The results of the test piece having no layer formed with Cytop but having only a water repellent layer derived from Compound 9 was also evaluated in the same manner. The results are shown in Table 18. The water repellent films exhibited a contact angle being decreased to 20° or less after immersion. It has been demonstrated from the results that in order to improve the immersion resistance, it is insufficient that the part having a perfluoroalkyl chain is bonded to form a water repellent film, but it is necessary to provide the composite film with the fluorine-containing polymer resin layer.

Example 10

Test pieces were produced in the same manner as in Example 1 except that the following Compound 10 was used instead of Compound 1.

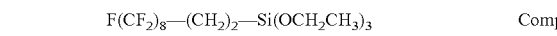

$F(CF_2)_8—(CH_2)_2—Si(OCH_2CH_3)_3$ Compound 10

The test pieces were subjected to the measurement of initial contact angles and contact angles after the rubbing test and the immersion test in the same manner as in Example 1. The results are shown in Table 19 below.

TABLE 19

Evaluation Results of Water Repellent Film of the Invention (using Compound 10)

| | | Plasma irradiation time upon forming film (sec) | | | |
|---|---|---|---|---|---|
| | | 0 | 100 | 300 | 1,000 |
| Initial contact angle (deg) | with water | 110 | 113 | 114 | 115 |
| | with UV curing ink | 54 | 55 | 56 | 57 |
| Contact angle after rubbing test (deg) | | 30 | 51 | 52 | 53 |
| Contact angle after immersion test (deg) | | 46 | 51 | 52 | 52 |

The test pieces having the Cytop layer and being irradiated with oxygen plasma exhibited a contact angle of 50° or more (from 51 to 53°) even after the rubbing operation 50,000 times. However, the test piece not being irradiated with oxygen plasma exhibited a contact angle decreasing to 30°. It has been demonstrated from the results that in order to improve the abrasion resistance, it is necessary that the part having a perfluoroalkyl chain is bonded to the fluorine-containing polymer resin layer.

A test piece having no fluorine-containing polymer resin layer formed with Cytop but only having a water repellent layer derived from Compound 10 was also evaluated in the same manner. The results are shown in Table 20 below.

TABLE 20

Evaluation Results of Water Repellent Film formed only with Compound 10

| | | Plasma irradiation time upon forming film (sec) | | | |
|---|---|---|---|---|---|
| | | 0 | 100 | 300 | 1,000 |
| Initial contact angle (deg) | with water | 115 | 115 | 116 | 116 |
| | with UV curing ink | 57 | 57 | 58 | 59 |
| Contact angle after rubbing test (deg) | | ≦20 | ≦20 | ≦20 | ≦20 |
| Contact angle after immersion test (deg) | | ≦20 | ≦20 | ≦20 | ≦20 |

The water repellent films exhibited a contact angle of from 57 to 59° in the initial state, but the contact angles thereof were decreased to 20° or less after rubbing. It has been demonstrated from the results that in order to improve the abrasion resistance, it is insufficient that the part having a perfluoroalkyl chain is bonded to form a water repellent film, but it is necessary to provide the composite film with the fluorine-containing polymer resin layer.

The test pieces were immersed in the UV curing ink for 30 days, and the contact angles after immersion were measured. The results are shown in Table 19. The test pieces having the Cytop layer and being irradiated with oxygen plasma exhibited a contact angle of 50° or more (from 51 to 52°) even after immersion for 30 days. However, the test piece not being irradiated with oxygen plasma exhibited a contact angle decreasing to less than 50° (46°). It has been demonstrated from the results that in order to improve the immersion resistance, it is necessary that the part having a perfluoroalkyl chain is bonded to the fluorine-containing polymer resin layer.

The results of the test piece having no layer formed with Cytop but having only a water repellent layer derived from Compound 10 was also evaluated in the same manner. The results are shown in Table 20. The water repellent films exhibited a contact angle being decreased to 20° or less after immersion. It has been demonstrated from the results that in order to improve the immersion resistance, it is insufficient that the part having a perfluoroalkyl chain is bonded to form a water repellent film, but it is necessary to provide the composite film with the fluorine-containing polymer resin layer.

Example 11

The same experiments as in Example 1 were carried out except that the plates having the fluorine-containing polymer resin layer formed thereon were exposed to an ozone atmosphere instead of irradiation with oxygen plasma. The ozone generator used herein was Model BA, produced by Roki Techno Co., Ltd., and the plates were exposed at an oxygen gas concentration of 25 g/Nm$^3$ for an exposing time of 10, 30 and 100 minutes, respectively. The results obtained are shown in Table 21 below.

TABLE 21

Evaluation Results of Water Repellent Film of the Invention (using Compound 1)

| | | Ozone exposure time upon forming film (sec) | | | |
|---|---|---|---|---|---|
| | | 0 | 10 | 30 | 100 |
| Initial contact angle (deg) | with water | 110 | 118 | 118 | 118 |
| | with UV curing ink | 54 | 60 | 61 | 62 |
| Contact angle after rubbing test (deg) | | 30 | 55 | 55 | 56 |
| Contact angle after immersion test (deg) | | 46 | 55 | 56 | 56 |

In the rubbing test, the contact angles were 50° or more (from 55 to 56°) after the rubbing operation 50,000 times even though exposure to an ozone atmosphere was used instead of irradiation with plasma. However, the test piece not being exposed to an ozone atmosphere exhibited a contact angle decreasing to 30°. It has been demonstrated form the results that the abrasion resistance can be improved by exposing to an ozone atmosphere instead of irradiation with plasma.

The results of the immersion test are shown in Table 21. The contact angles were 50° or more (from 55 to 56°) after immersion even though exposure to an ozone atmosphere was used instead of irradiation with plasma. However, the test piece not being exposed to an ozone atmosphere exhibited a contact angle decreasing to less than 50° (46°). It has been demonstrated from the results that the immersion resistance can be improved by exposing to an ozone atmosphere instead of irradiation with plasma.

There was such a tendency that improvement in effects of the rubbing and immersion tests was small even in the case where the time for exposing to an ozone atmosphere was prolonged, as compared to the time dependency in plasma irradiation. It has been also demonstrated from comparison to the results in Example 1 that in the case where the time for the pretreatment upon bonding the part having a perfluoropolyether chain or a perfluoroalkyl chain (i.e., plasma irradiation and exposure to an ozone atmosphere) can be prolonged, a water repellent film having better abrasion resistance and immersion resistance can be obtained with the plasma irradiation.

Example 12

The same experiments as in Example 1 were carried out except that the plates having the fluorine-containing polymer resin layer formed thereon were irradiated with an UV ray instead of irradiation with oxygen plasma. The UV ray irradiating device used herein was 500 W deep-UV lamp, produced by Ushio, Inc., and the plates were irradiated for an irradiation time of 10, 30 and 100 minutes, respectively. The results obtained are shown in Table 22 below.

TABLE 22

Evaluation Results of Water Repellent Film of the Invention (using Compound 1)

| | | UV ray irradiation time upon forming film (sec) | | | |
|---|---|---|---|---|---|
| | | 0 | 10 | 30 | 100 |
| Initial contact angle (deg) | with water | 110 | 118 | 118 | 118 |
| | with UV curing ink | 54 | 60 | 61 | 62 |
| Contact angle after rubbing test (deg) | | 30 | 55 | 55 | 56 |
| Contact angle after immersion test (deg) | | 46 | 55 | 55 | 55 |

In the rubbing test, the contact angles were 50° or more (55°) after the rubbing operation 50,000 times even though irradiation with an UV ray was used instead of irradiation with plasma. However, the test piece not being irradiated with an UV ray exhibited a contact angle decreasing to 30°. It has been demonstrated from the results that the abrasion resistance can be improved by irradiating with an UV ray instead of irradiation with plasma.

The results of the immersion test are shown in Table 22. The contact angles were 50° or more (from 55 to 56°) after immersion even though irradiation with an UV ray was used instead of irradiation with plasma. However, the test piece not being irradiated with an UV ray exhibited a contact angle decreasing to less than 50° (46°). It has been demonstrated from the results that the immersion resistance can be improved by irradiating with an UV ray instead of irradiation with plasma.

There was such a tendency that improvement in effects of the rubbing and immersion tests was small even in the case where the time for irradiating with an UV ray was prolonged, as compared to the time dependency in plasma irradiation. It has been also demonstrated from comparison to the results in Example 1 that in the case where the irradiation time can be prolonged, a water repellent film having better abrasion resistance and immersion resistance can be obtained with the plasma irradiation.

Example 13

The same water repellent films as produced in Examples 1 to 10 were formed on SUS304 test pieces in the same manner as in Example 1. The test pieces thus obtained were subjected to the rubbing test in the same manner as in Example 1 except that the number of rubbing operations was increased by three times (i.e., 150,000 times of rubbing operations) and were measured for contact angle. The results are shown in Table 23 below.

TABLE 23

Contact angles after three times number of rubbing operations

| | Plasma irradiation time upon forming film (sec) | | |
|---|---|---|---|
| Compound used | 100 | 300 | 1,000 |
| Compound 1 | 52 | 53 | 54 |
| Compound 2 | 52 | 53 | 54 |
| Compound 3 | 53 | 54 | 54 |
| Compound 4 | 53 | 54 | 54 |
| Compound 5 | 53 | 54 | 54 |
| Compound 6 | 53 | 54 | 55 |
| Compound 7 | 53 | 54 | 55 |
| Compound 8 | 53 | 54 | 55 |

TABLE 23-continued

| Contact angles after three times number of rubbing operations | | | |
|---|---|---|---|
| | Plasma irradiation time upon forming film (sec) | | |
| Compound used | 100 | 300 | 1,000 |
| Compound 9 | 44 | 45 | 46 |
| Compound 10 | 45 | 45 | 46 |

The test pieces using Compounds 1 to 8 maintained a contact angle of 50° or more (from 52 to 55°) even after the rubbing operation 150,000 times. However, the test pieces using Compounds 9 and 10 exhibited contact angles decreasing to less than 50° (from 44 to 46°). In the test pieces using Compounds 1 to 8, the part having a perfluoropolyether chain is bonded to the fluorine-containing polymer resin layer. In the test pieces using Compounds 9 and 10, the part having a perfluoroalkyl chain is bonded thereto. Therefore, it has been demonstrated from the results that the part having a perfluoropolyether chain is preferred as a part to be bonded to the fluorine-containing polymer resin layer owing to the high abrasion resistance.

Example 14

Figure 5:
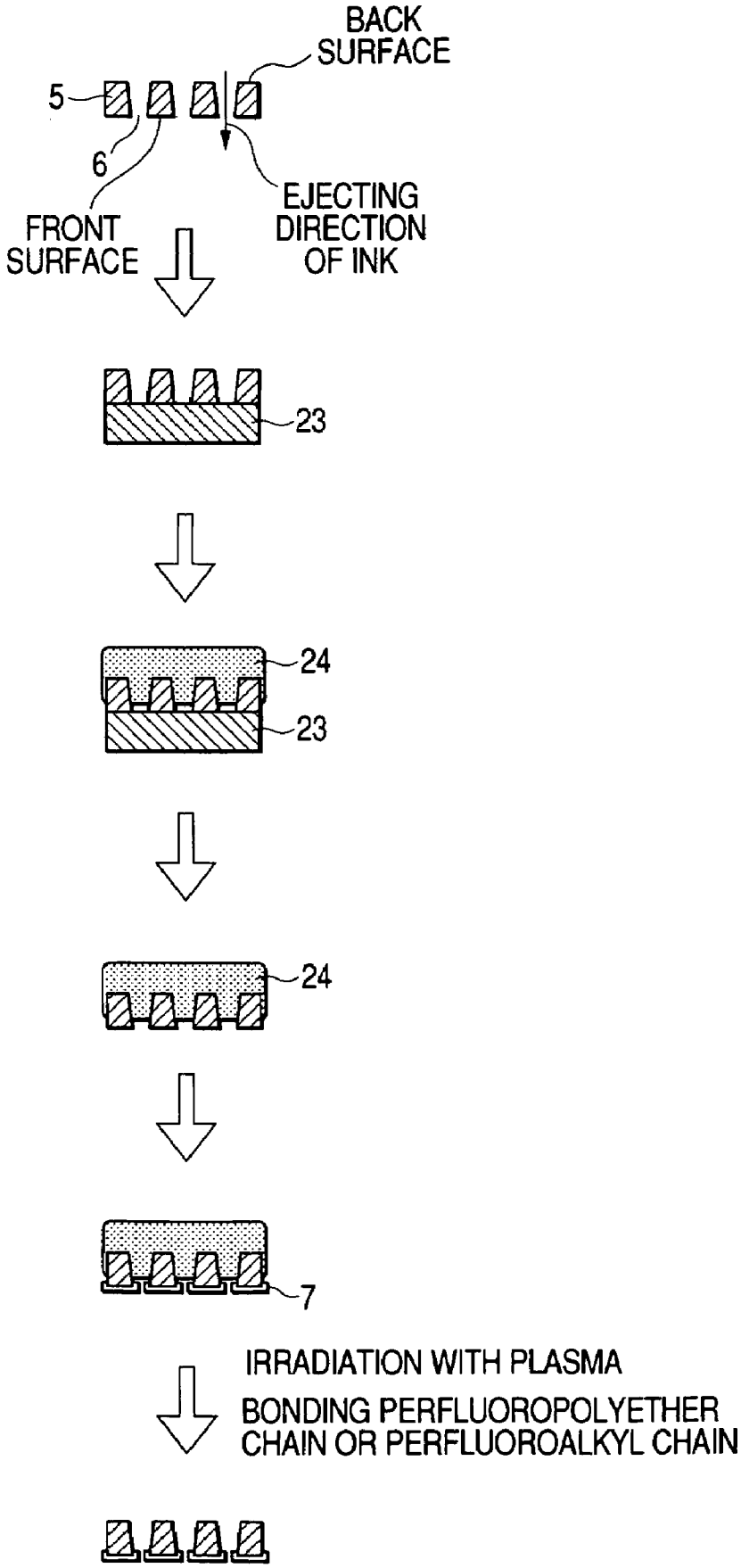
FIG. 5 is a schematic process diagram showing the process for forming a water repellent film on an orifice plate.

A process for forming a water repellent film on a surface of an orifice plate will be described in detail below. FIG. 5 shows a schematic process diagram showing the process. In the following description, the orifice surface on the side of ink ejection is referred to as a front surface, and the orifice surface on the side of an ink chamber is referred to as a back surface.

An orifice plate 5 is prepared, which is formed with SUS304 with a thickness of 80 μm and has nozzles having a diameter on the ink ejection side of 40 μm. An industrial adhesive tape, Model No. 966, produced by 3M Corp., is adhered as a masking tape 23 on the front surface, and is applied with a pressure of $1.0\times10^5$ kg/m$^2$ for 30 seconds. Subsequently, a 15% by weight aqueous solution of polyvinyl alcohol (number of repeating units: 1,500 per molecule), produced by Wako Pure Chemical Industries, Ltd. as a water soluble resin is coated on the back surface. The solution is dried at ordinary temperature to from a mask layer 24. The masking tape 23 is removed, and a 1% by weight solution of Cytop is coated on the orifice plate 5 by the dip method and heated at 120° C. for 1 hour to form a water repellent film 7 formed with Cytop on the front surface. The updrawing speed of the orifice plate upon coating by the dip coating method is 10 mm/sec.

The front surface is then irradiated with oxygen plasma with Plasma Dry Cleaner PDC-210, produced by Yamato Glass Co., Ltd. The output electric power of a high frequency power source of the apparatus is 100 W upon irradiation. The irradiation time is 1,000 seconds. After irradiation of plasma, the plate is immediately immersed in a solution of Compound 1 dissolved in HFE-7200 (a fluorine solvent, produced by 3M Corp.) of a concentration of 0.1% by weight for 1 hour. The plate is updrawn from the solution and heated at 120° C. for 10 minutes. After cooling the orifice plate to ordinary temperature, it is rinsed with HFE-7200 to remove excessive Compound 1. An orifice plate having a water repellent film according to the invention is completed through the aforementioned process.

The orifice plate is immersed in water at 80° C. in a beaker, and the beaker is vibrated with an ultrasonic washing machine for 10 minutes. It is vibrated with the ultrasonic washing machine for 10 minutes after replacing water, and the same operation is further repeated three times to remove the mask layer. An orifice plate having a water repellent film formed on the front surface having ink ejection nozzles is thus produced. The front surface of the orifice plate thus produced has a contact angle of 120° with water and a contact angle of 67° with an UV curing ink (surface tension: 28 mN/m) used in the following image formation process.

The orifice plate is fixed to a housing of an ink-jet head using an adhesive (Model no. 2210, produced by Three Bond Co., Ltd.) along with an ink filter, an electrode, a piezoelectric element and the like to produce an ink-jet head shown in FIGS. 3A and 3B.

1 part by weight of a 6% by weight silica sol solution (having pH adjusted to 3 to 4 with nitric acid and containing ethanol as a main component of a solvent), 1 part by weight of colloidal silica (Snowtex IPA-ST, produced by Nissan Chemical Industries, Ltd.) and 20 parts by weight of ethanol are mixed to prepare a hydrophilic coating composition.

The hydrophilic coating composition is charged in the common ink chamber and the individual ink chambers of the ink-jet head, and then discharged from all the nozzles. The amount of the coating composition discharged from one nozzle per one operation is 100 pL, and the discharging operation is repeated 10 times. The hydrophilic coating composition is thus made in contact with the flow channel from the ink chamber to the nozzles. Thereafter, hot air at 100° C. is fed from the ink chamber for 1 hour to form a hydrophilic layer. The hydrophilic coating composition is repelled on the front surface of the orifice plate having the water repellent film formed thereon. It has been confirmed therefore that the hydrophilic coating composition is not coated on the water repellent film.

An ink-jet head produced in the aforementioned process was installed in an ink-jet printer shown in FIGS. 4A and 4B. Image formation was carried out by using the ink-jet printer to evaluate images thus formed.

An ink (UV curing ink) was charged in the ink chamber, and an image was printed. The ink was ejected from all the nozzles in a substantially perpendicular direction to form a desired image.

The front surface of the orifice plate of the ink-jet head was rubbed 50,000 times with the wiping mechanism of the maintenance mechanism 22. The rubbing operation was carried out at a pressure of 100 g/cm$^2$, a velocity of 10 mm/sec and a rubbing length of 10 mm, and one drop (50 μL) of the UV curing ink was dropped on the silicone rubber sheet per 10 times of the rubbing operations. After completing the rubbing operations, an image was printed. The ink was ejected from all the nozzles in a substantially perpendicular direction to form a desired image. As described in the foregoing, the number of rubbing operations of 50,000 corresponds to a period of service of about 3 years.

It has been demonstrated from the aforementioned results that the ink-jet head having the water repellent film according to the invention on the surface of the orifice plate is excellent in abrasion resistance of the water repellent film, and thus the ejecting direction of an ink ejected from the nozzles is substantially not changed for a prolonged period of time. It has also been demonstrated that the ink-jet printer using the ink-jet head according to the invention can attain stable image formation for a prolonged period of time.

Example 15

The same evaluation as in Example 14 was carried out except that Compound 2 was used instead of Compound 1. The ink was ejected from all the nozzles in a substantially perpendicular direction to form a desired image before and after rubbing 50,000 times.

The same evaluation as in Example 14 was carried out except that Compounds 3 to 10 instead of Compound 1. The ink was ejected from all the nozzles in a substantially perpendicular direction to form a desired image before and after rubbing 50,000 times.

It has been demonstrated from the results in this example that the ink-jet head having the water repellent film according to the invention on the surface of the orifice plate is excellent in abrasion resistance of the water repellent film, and thus the ejecting direction of an ink ejected from the nozzles is substantially not changed for a prolonged period of time. It has also been demonstrated that the ink-jet printer using the ink-jet head according to the invention can attain stable image formation for a prolonged period of time.

Comparative Example 1

The same evaluation as in Examples 14 and 15 was carried out except that the water repellent film having the fluorine-containing polymer resin layer formed with Cytop was not formed, but a water repellent film formed only with one of Compounds 1 to 10 was formed. As a result, the ink was ejected from all the nozzles after rubbing 50,000 times, but the ejecting direction of the ink was deviated from the perpendicular direction by from 5 to 30° to form deteriorated images that are long way from a desired image. The contact angle on the surface of the orifice plate of the ink-jet head thus measured was from 20° or less to 38° with the UV curing ink. It is considered that this is because the ink is liable to be attached to the surface of the water repellent film due to deterioration thereof caused by the rubbing operation, and ink droplets in the vicinity of the nozzle is disturbed in ejecting direction. Therefore, it has been demonstrated from the comparative example that a water repellent film containing a fluorine-containing polymer resin layer having bonded thereon a part having a perfluoropolyether chain or a perfluoroalkyl chain has practical abrasion resistance and is capable of attaining stable image formation for a prolonged period of time.

Comparative Example 2

The same evaluation as in Example 14 was carried out except that the water repellent film having only the fluorine-containing polymer resin layer formed with Cytop was formed. As a result, the ink was ejected from all the nozzles after rubbing 50,000 times, but the ejecting direction of the ink was deviated from the perpendicular direction by from 5 to 30° to form deteriorated images that are long way from a desired image. The contact angle on the surface of the orifice plate of the ink-jet head thus measured was 30° with the UV curing ink. It is considered that this is because the ink is liable to be attached to the surface of the water repellent film due to deterioration thereof caused by the rubbing operation, and ink droplets in the vicinity of the nozzle is disturbed in ejecting direction. Therefore, it has been demonstrated from the comparative example that a water repellent film containing a fluorine-containing polymer resin layer having bonded thereon a part having a perfluoropolyether chain or a perfluoroalkyl chain has practical abrasion resistance and is capable of attaining stable image formation for a prolonged period of time.

Example 16

The same evaluation as in Examples 14 and 15 was carried out except that the number of rubbing operations was increased by three times (i.e., 150,000 times of rubbing operations). As a result, in the cases where Compounds 1 to 8 were used, the ink was ejected from all the nozzles in a substantially perpendicular direction to form a desired image even after rubbing 150,000 times. However, in the case where Compound 9 or 10 was used, the ink was ejected from all the nozzles after rubbing 150,000 times, but the ejecting direction of the ink was deviated from the perpendicular direction by from 5 to 20° to form deteriorated images that are long way from a desired image. The contact angle on the surface of the orifice plate of the ink-jet head thus measured was 46° with the UV curing ink. It is considered that this is because, as similar to the cases of Comparative Examples 1 and 2, the ink is liable to be attached to the surface of the water repellent film due to deterioration thereof caused by the rubbing operation, and ink droplets in the vicinity of the nozzle is disturbed in ejecting direction. Therefore, it has been demonstrated from this example that a water repellent film containing a fluorine-containing polymer resin layer having bonded thereon a part having a perfluoropolyether chain has excellent abrasion resistance in comparison to that using a part having a perfluoroalkyl chain, and an ink-jet head using the water repellent film suffers substantially no change in ejecting direction of an ink ejected from the nozzles for a longer period of time. It has also been demonstrated that an ink-jet printer using the ink-jet head is capable of attaining stable image formation for a prolonged period of time.

According to the invention, an ink-jet head capable of attaining stable ink charge and an ink-jet printer capable of attaining stable image formation can be provided by using a water repellent film having high abrasion resistance and an orifice plate using the same.

What is claimed is:

1. An ink-jet head comprising:

a plate having an orifice for ejecting an ink for forming an image; and a water repellent film formed on a wall defining said orifice for repelling the ink, wherein the water repellent film comprises a fluorine-containing polymer resin layer and a moiety comprising at least one of a perfluoropolyether chain and a perfluoroalkyl chain bonded to the layer, and wherein said fluorine-containing polymer resin layer comprises an irradiated layer which has been irradiated to form a substituent on a surface of said fluorine-containing polymer resin layer.

2. The ink-jet head according to claim 1, wherein the moiety comprises a perfluoropolyether chain on the fluorine-containing polymer resin layer, said moiety being formed with a compound having one of the following chemical formulae:

$$F\{CF(CF_3)—CF_2O\}_n—CF(CF_3)—X—Si(OR)_3$$

$$F\{CF(CF_3)—CF_2O\}_n—CF(CF_3)—X—Si(OR)_2R$$

$$F(CF_2CF_2CF_2O)_nCF_2CF_2—X—Si(OR)_3$$

$$F(CF_2CF_2CF_2O)_nCF_2CF_2—X—Si(OR)_2R$$

$$[F\{CF(CF_3)—CF_2O\}_nCF(CF_3)]_2Y—Si(OR)_3$$

$$[F\{CF(CF_3)—CF_2O\}_nCF(CF_3)]_2Y—Si(OR)_2R$$

$\{F(CF_2CF_2CF_2O)_nCF_2CF_2\}_2Y—Si(OR)_3$ $\{F(CF_2CF_2CF_2O)_nCF_2CF_2\}_2Y—Si(OR)_2R$ where X and Y each represents a part at which the perfluoropolyether chain and an alkoxysilane residual group are bonded each other, and R represents an alkyl group.

3. The ink-jet head according to claim 2, wherein the moiety is bonded to said fluorine-containing polymer resin layer by reacting said compound with a hydroxyl group formed on a surface of said fluorine-containing polymer resin layer.

4. The ink-jet head according to claim 2, wherein said X and Y comprise a member selected from the group consisting of an amide and an ether.

5. The ink-jet head according to claim 2, wherein said moiety is bonded to said fluorine-containing polymer resin layer by reacting said compound with said substituent.

6. The ink-jet head according to claim 1, wherein the water repellent film is formed on an inner surface of the wall defining said orifice to a depth of ¼ or less of an opening diameter of the orifice from the surface of the wall defining said orifice.

7. The ink-jet head according to claim 1, wherein the water repellent film comprises a moiety having a perfluoroalkyl chain bonded on the fluorine-containing polymer resin layer.

8. The ink-jet head according to claim 1, wherein said fluorine-containing polymer resin layer comprises one member selected from a group consisting of polytetrafluoroethylene (PTFE), a tetrafluoroethylene-perfluoroalkyl vinyl ether copolymer (PFA), a tetrafluoroethylene-hexafluoropropylene copolymer (FEP), polychlorotetrafluoroethylene copolymer (PCTFE), a tetrafluoroethylene-ethylene copolymer (ETFE), a chlorotrifluoroethylene-ethylene copolymer (ECTFE), polyvinylidene fluoride (PVdF) and polyvinyl fluoride (PVF).

9. The ink-jet head according to claim 1, wherein the water repellent film comprises a moiety having a perfluoropolyether chain bonded on the fluorine-containing polymer resin layer.

10. The ink-jet head according to claim 9, wherein said perfluoropolyether chain comprises a plurality of perfluoropolyether chains.

11. The ink-jet head according to claim 1, wherein said water repellant film repels an aqueous ink which is soluble in water and an oil-based ink which is insoluble or hardly soluble in water.

12. The ink-jet head according to claim 1, wherein said irradiated layer comprises an layer which has been treated by one of irradiating with an oxygen plasma, irradiating with an ultra-violet (UV) ray, and exposure to ozone.

13. The ink-jet head according to claim 1, wherein said water repellant film is formed on a surface of said plate which is outside of said orifice.

14. The ink-jet head according to claim 1, wherein said water repellant film is formed on only a portion of said wall defining said orifice.

15. The ink-jet head according to claim 14, further comprising:

a hydrophilic film formed on another portion of said wall defining said orifice, and on a surface of said plate which is outside of said orifice.

16. An ink-jet head comprising:

a plate having an orifice for ejecting an ink for forming an image; and a water repellent film formed on a wall defining said orifice for repelling the ink on a surface of the orifice, wherein the water repellent film comprises a fluorine-containing polymer resin layer and a moiety comprising at least one of a perfluoropolyether chain and a perfluoroalkyl chain bonded to the layer, wherein the water repellent film is produced by a process comprising:

coating a solution containing a fluorine-containing polymer resin and evaporating a solvent to form the fluorine-containing polymer resin layer;

irradiating the fluorine-containing polymer resin layer with oxygen plasma;

coating a solution containing at least one of a perfluoropolyether compound having an alkoxysilane residual group at an end thereof and a perfluoroalkyl compound having an alkoxysilane residual group at an end thereof on a surface of the fluorine-containing polymer resin layer; and heating the coated layer to bond at least one of the perfluoropolyether compound and the perfluoroalkyl compound on the surface of the fluorine-containing polymer resin layer, and wherein said fluorine-containing polymer resin layer comprises an irradiated layer which has been irradiated to form a substituent on a surface of said fluorine-containing polymer resin layer.

17. An ink-jet printer comprising:

an ink-jet head for ejecting an ink for forming an image, wherein the ink-jet head comprises:

a plate comprising an orifice; and a water repellent film formed on a wall defining said orifice for repelling the ink, wherein the water repellent film comprises a fluorine-containing polymer resin layer and a moiety comprising at least one of a perfluoropolyether chain and a perfluoroalkyl chain bonded to the layer, and wherein said fluorine-containing polymer resin layer comprises an irradiated layer which has been irradiated to form a substituent on a surface of said fluorine-containing polymer resin layer.

18. The ink-jet printer according to claim 17, wherein the moiety comprises a perfluoropolyether chain on the fluorine-containing polymer resin layer, said moiety being formed with a compound having one of the following chemical formulae:

$F\{CF(CF_3)—CF_2O\}_n—CF(CF_3)—X—Si(OR)_3$ $F\{CF(CF_3)—CF_2O\}_n—CF(CF_3)—X—Si(OR)_2R$ $F(CF_2CF_2CF_2O)_nCF_2CF_2—X—Si(OR)_3$ $F(CF_2CF_2CF_2O)_nCF_2CF_2—X—Si(OR)_2R$ $[F\{CF(CF_3)—CF_2O\}_nCF(CF_3)]_2Y—Si(OR)_3$ $[F\{CF(CF_3)—CF_2O\}_nCF(CF_3)]_2Y—Si(OR)_2R$ $\{F(CF_2CF_2CF_2O)_nCF_2CF_2\}_2Y—Si(OR)_3$ $\{F(CF_2CF_2CF_2O)_nCF_2CF_2\}_2Y—Si(OR)_2R.$

19. The ink-jet printer according to claim 17, wherein the water repellent film is formed on an inner surface of the wall defining said orifice to a depth of ¼ or less of an opening diameter of the orifice from the surface of the wall defining said orifice.

* * * * *